US007382861B2

(12) United States Patent
Madey et al.

(10) Patent No.: US 7,382,861 B2
(45) Date of Patent: Jun. 3, 2008

(54) HIGH EFFICIENCY MONOCHROMATIC X-RAY SOURCE USING AN OPTICAL UNDULATOR

(75) Inventors: John M. J. Madey, 3302 Oahu Ave., Honolulu, HI (US) 96822; Eric B. Szarmes, Honolulu, HI (US)

(73) Assignee: John M. J. Madey, Honolulu, HI (US)

( * ) Notice: Subject to any disclaimer, the term of this patent is extended or adjusted under 35 U.S.C. 154(b) by 0 days.

(21) Appl. No.: 11/421,351

(22) Filed: May 31, 2006

(65) Prior Publication Data

US 2007/0014392 A1 Jan. 18, 2007

Related U.S. Application Data

(60) Provisional application No. 60/687,014, filed on Jun. 2, 2005.

(51) Int. Cl.
*H05G 2/00* (2006.01)

(52) U.S. Cl. ..... 378/119

(58) Field of Classification Search ..... 378/119; 372/5

See application file for complete search history.

(56) References Cited

U.S. PATENT DOCUMENTS

| | | | | |
|---|---|---|---|---|
| 4,598,415 | A * | 7/1986 | Luccio et al. | 378/119 |
| 5,247,562 | A * | 9/1993 | Steinbach | 378/119 |
| 5,495,515 | A * | 2/1996 | Imasaki | 378/119 |
| 5,825,847 | A | 10/1998 | Ruth et al. | 378/119 |
| 6,035,015 | A | 3/2000 | Ruth et al. | 378/119 |
| 6,724,782 | B2 | 4/2004 | Hartemann et al. | 372/5 |

OTHER PUBLICATIONS

Crosbie et al., "Improvement of the Dynamic Aperture in Chasman Green Lattice Design Light Source Storage Rings," *IEEE*, proceedings of PAC 1987, pp. 443-445 (1987).

Fukasawa et al., "Compact Hard X-Ray Source Via Inverse Compton Scattering Based on the X-Band Linac,", Proceedings of the Second Asian Particle Accelerator Conference, Beijing, China, 2001, 3 pages.

Doucet et al., eds., *Industrial and Commercial Unit, A Light for Industry*, brochure of European Synchrotron Radiation Facility, pp. 1-30 (2002).

"Joint Accelerator Conference Website, A service for the whole accelerator community," poster, http://www.JACoW.org/. More than one year before Jun. 2, 2005.

Korchuganov et al., "The Nanohana 2 GeV Synchrotron light source," *Nuc. Instruments and Methods in Physics Res.*, 448:27-31 (2000).

LaClare, J. L., "Light Source Performance Achievements," pp. 78-81. More than one year before Jun. 2, 2005.

Nghiem et al., "Optics for Soleil at 2.5 GEV," *IEEE*, pp. 1406-1408 (1998).

* cited by examiner

*Primary Examiner*—Courtney Thomas
(74) *Attorney, Agent, or Firm*—Townsend and Townsend and Crew LLP

(57) ABSTRACT

A method of generating energetic electromagnetic radiation comprises, during each of a plurality of separated radiation intervals, injecting laser radiation of a given wavelength into an optical cavity that is characterized by a round-trip transit time (RTTT) for radiation of that given wavelength. At least some radiation intervals are defined by one or more optical macropulses, at least one optical macropulse gives rise to an associated circulating optical micropulse that is coherently reinforced by subsequent optical micropulses in the optical macropulse and the electric field amplitude of the circulating optical micropulse at any given position in the cavity reaches a maximum value during the radiation interval.

31 Claims, 12 Drawing Sheets

TWO Independent Interleaved Optical Micropulse Trains (Macropulses) Leading To TWO Circulating Stored Optical micropulses

HIGH EFFICIENCY MONOCHROMATIC X-RAY SOURCE USING AN OPTICAL UNDULATOR

CROSS-REFERENCE TO RELATED APPLICATION

This application claims the benefit of 35 U.S.C. § 119(e) of U.S. Patent Application No. 60/687,014, filed Jun. 2, 2005, the entire disclosure of which is incorporated by reference.

BACKGROUND OF THE INVENTION

The present invention relates generally to the production of x-rays and other energetic electromagnetic radiation (short wavelengths), and more specifically to techniques for interacting relativistic electrons with electromagnetic radiation having relatively long wavelengths to generate electromagnetic short-wavelength radiation.

The unique ability of electron beam-based sources of electromagnetic radiation employing undulators to generate intense, near monochromatic, forward peaked beams of radiation have made undulators critical components of advanced light sources such as second and third-generation synchrotron radiation sources and free-electron lasers. There are therefore many references to undulator technology and the use of undulators in the literature, beginning with Motz' pioneering description of the concept and first demonstration at Stanford (Motz 1951) to the many published descriptions of the concept and its implementation in connection with the development of the free-electron laser (Madey 1971) and the second generation synchrotron radiation sources at Brookhaven National Laboratory (Decker 1996), Lawrence Berkeley Laboratory (Robinson 1991), the Stanford Linear Accelerator Center (Hettel 2002) and Argonne National Laboratory (Galayda 1995).

Almost all such systems constructed to date employ undulators constructed as a linear array of dipole magnets designed to create a static, transverse, spatially periodic magnetic field in which the magnetic component of the Lorentz force ev×B imposes both a periodic transverse acceleration and a periodic transverse velocity on the motion of the electrons moving through the field. Typical magnet periods range from somewhat less than a cm to the order of 10 cm depending on the wavelength of radiation desired and the energy of the electron beams available for use in the system. To maximize the radiated power while limiting emission at the harmonics, these systems are typically operated at normalized vector potentials $a_n$ of order between 0.1 and 1.0. Typical undulator lengths range from 1 to 10 meters as required to achieve the desired spectral bandwidth. As an example, an undulator operating at with $a_n^2$32 0.2 designed to produce x-rays of 10 angstroms wavelength with a spectral bandwidth of 1% at an electron energy of 3.0 GeV and an electron beam with minimal angular divergence would have a period of 5.7 cm and a length of 3 meters.

The extended length of the undulators used for such systems, together with the size, cost and complexity of the accelerator systems needed to generate the high energy, high power electron beams required for operation, have made such light sources both physically large and expensive. As examples, the X-ray light sources at Brookhaven, Lawrence Berkeley Laboratory, Stanford, and Argonne have, respectively, diameters of 54, 63. 75, and 350 meters with construction costs ranging from $160 million to $500 million.

A related physical phenomenon, inverse Compton scattering, has also been investigated as a means for production of short wavelength electromagnetic radiation in synchrotron radiation sources (Ruth 1998, Ruth 2000, and Harteman 2004) and free-electron lasers (Elias 1979). The inverse-Compton mechanism combines two basic physical effects, Compton scattering in which an incident electromagnetic wave is scattered by a single electron, and the Doppler shift, in which the radiation emitted by moving charges is upshifted in frequency along the direction of motion.

However, the concept of Compton scattering as described in the literature (Heitler 1960) is applicable only when the mechanism can be described as the scattering of single photons, and is no longer valid when the electric and magnetic fields of the incident electromagnetic wave are strong enough to induce transverse velocities approaching the speed of light, e.g., when their normalized vector potential approaches unity. Given this restriction to low field amplitudes and the dependence of the radiated power on the square of the field amplitude, electron beam-based inverse-Compton light sources have simply not proven competitive with undulator-based light sources to date.

SUMMARY OF THE INVENTION

In one aspect of the invention, a method of generating energetic electromagnetic radiation comprises, during each of a plurality of separated radiation intervals, injecting laser radiation of a given wavelength into an optical cavity that is characterized by a round-trip transit time (RTTT) for radiation of that given wavelength. At least some radiation intervals are defined by one or more optical macropulses, at least one optical macropulse gives rise to an associated circulating optical micropulse that is coherently reinforced by subsequent optical micropulses in the optical macropulse, and the electric field amplitude of the circulating optical micropulse at any given position in the cavity reaches a maximum value during the radiation interval.

The term "laser" is used since lasers represent the only practical (in terms of power) source of coherent radiation at the present time. Should newly discovered coherent light sources prove useful, the term "laser" would be intended to cover such sources.

In this method, at least one optical macropulse that gives rise to a circulating optical micropulse consists of a series of optical micropulses characterized in that the spacing between the start of one optical micropulse and the start of the next is sufficiently close to an exact integral multiple (including 1×) of the RTTT for radiation of the given wavelength to provide at least 50% spatial overlap between injected optical micropulses and the circulating optical micropulse given rise to by that optical macropulse, and the injected optical micropulses in that optical macropulse are within ±45° of optical phase with the circulating optical micropulse given rise to by that optical macropulse.

The method further comprises focusing the circulating micropulse at an interaction region in the cavity so that when the electric field amplitude of the circulating optical micropulse is at or near its maximum value, the circulating optical micropulse provides an optical undulator field in the interaction region characterized by a normalized vector potential greater than 0.1, and directing an electron beam that includes a series of electron micropulses toward the interaction region in the cavity. At least some of the electron micropulses are synchronized with the circulating optical micropulse in the cavity, and the electron beam is focused at the interaction region in the cavity so at least one electron micropulse interacts with the optical undulator field in the interaction region and generates electromagnetic radiation at an optical frequency higher than the laser radiation's optical frequency.

According to one aspect of the invention, operation at levels of performance comparable to those attainable at the current generation of undulator-based synchrotron radiation sources can be obtained using an optical undulator, that is, a series of intense optical pulses in which the normalized vector potential is raised to the order of 0.1 or more, the range of values in which the emission of ultraviolet, x-ray and gamma ray radiation by relativistic electrons moving through this series of pulses is optimized. But in contrast to permanent magnet undulators operating at this normalized vector potential, the x-ray power radiated per unit length in such an optical undulator is larger by factor of the order of 10,000.

Equally important, the electron energy required for operation of such sources is reduced by the square root of the same factor making possible very substantial reductions in size, cost and operating expense. Finally, in contrast to short wavelength radiation sources based on the use of magnetic undulators, the ability to alter the wavelength and format of the optical pulse train comprising the optical undulator on successive radiation intervals makes possible a level of flexibility in the generation of the single and multi-color x-ray pulses required for use unattainable through use of a conventional magnetic undulator.

The optical properties of near-concentric optical cavities make possible the generation of the intense optical pulses needed for operation of the invention by integrating the optical power injected into the cavity from one or more low power pump lasers, and focusing that accumulated energy to a small spot in the vacuum within the cavity. By appropriate design, the peak optical power density and fluence at the interior surfaces of the cavity can be reduced by diffraction to a level consistent with the peak power damage thresholds of those surfaces. The fluence and average optical power incident on these surfaces can be further kept below the integrated pulse and average power damage thresholds by limiting the interval of time over which the pump laser(s) inject optical power into the cavity.

As a matter of terminology, it is convenient to refer to the individual optical pulses injected into or stored within the optical cavity as optical micropulses, and to refer to the spaced intervals during which such optical micropulses are injected into the optical cavity as the radiation intervals. The laser radiation incident on the cavity thus has a hierarchical pulse structure that is characterized by two disparate time scales, namely that of the radiation intervals and that of the micropulses. As will be described below, the system and method are configured so that optical micropulses injected into the cavity coherently reinforce optical micropulses circulating in the cavity, thus causing the amplitude of a given circulating optical micropulse to increase.

In this application, the term "coherently reinforce" in the context of an injected optical micropulse coherently reinforcing a circulating optical micropulse will be used to mean that the amplitudes of the injected optical micropulse and the circulating optical micropulse add. This will occur if the two are in exact optical phase with each other, but the term also contemplates a possible degree of departure from zero phase difference. Similarly, the term contemplates a possible departure from 100% overlap between the envelopes (width and arrival time) of the injected optical micropulses and the circulating optical micropulse.

For example, in a representative embodiment, a ±20-degree phase difference between the phase of the injected optical micropulses and the phase of the circulating optical micropulse would still provide relatively efficient reinforcement. Similarly a non-overlap between of the envelopes of the injected micropulses by 10% of the circulating micropulse width would still provide relatively efficient reinforcement.

Thus, efficient reinforcement is achieved by maintaining the phase of the injected micropulses within ±20° of the phase of the circulating stored micropulse, and maintaining the temporal width and time of arrival of the envelopes of the injected micropulses within 10% of the width of the circulating optical micropulse(s). However, the definition of "coherent reinforcement is broad enough to include phase differences out to a limit on the order of ±45°, and non-overlap on the order of ±50% of the optical micropulse duration, even though this results in lower injection efficiency and higher injected optical micropulse power for the same value of $a_n$.

Each time a circulating optical micropulse is coherently reinforced by an injected optical micropulse, the circulating optical micropulse's amplitude increases at that moment. However, after one round trip, the circulating optical micropulse's amplitude will decrease due to cavity losses. So long as the cavity losses for a round trip are less than the increase due to the coherent reinforcement, the circulating optical micropulse's amplitude will continue to grow. Since mirror losses are proportional to the incident optical power as a percentage, the larger the amplitude, the larger the loss. At some point, the cavity losses will equal the amount of the coherent reinforcement, and the circulating optical micropulse's amplitude will stop growing. Certainly, once the optical macropulse ends, the circulating optical micropulse's amplitude will start to decay.

In this application, the term "optical macropulse" will be used to mean a series of micropulses within a radiation interval characterized by having the spacing between the start of one optical micropulse and the start of the next equal to substantially an exact integral multiple (including 1×) of the time interval for an optical micropulse to make a single round-trip transit of the optical cavity. We will refer to this round-trip transit time interval as the "RTTT." By this definition, a single given optical macropulse consists of a series of optical micropulses that coherently reinforce (subject to possible other constraints) a single circulating optical micropulse. The optical micropulses are generally of substantially equal duration.

It should be noted that this definition does not require that all the optical micropulses in the optical macropulse be equally spaced. Rather, one optical micropulse in the optical macropulse can be spaced from its preceding optical micropulse by a first integral multiple of the RTTT while another optical micropulse in the optical macropulse can be spaced from its preceding optical micropulse by a second integral multiple of the RTTT that is different from the first integral multiple of the RTTT. Most embodiments will be characterized by the optical macropulses having equally spaced optical micropulses, but this is not necessary for coherent reinforcement of the circulating optical micropulse.

A corollary of this is that if two optical micropulses are separated by other than an integral multiple of the RTTT, they belong to different optical macropulses (or one or both are not part of an optical macropulse). For example, if the optical micropulses being injected into the cavity were separated by ½ the round-trip transit time, this would be considered to constitute two overlapping optical macropulses with their respective optical micropulses interleaved. Injecting these two optical macropulses into the cavity would, subject to possible other constraints, lead to coherent reinforcement of two distinct circulating optical micropulses. Put another way, the definition of optical macropulse leads to the result that all the optical micropulses in an optical macropulse will coherently reinforce the same circulating optical micropulse. Other examples can be described in which the two overlapping optical macropulses are interleaved with an arbitrary relative time delay.

There may be instances, such as certain diagnostic applications, where it is desired to inject one or more optical micropulses that do not meet any specific timing constraint and do not coherently reinforce any circulating optical micropulse. These might be thought of as orphan optical micropulses since they don't belong to an optical macropulse. It is noted that the optical macropulse duration may be substantially the same as the radiation interval duration, or shorter than the radiation interval. Where the optical macropulse duration is shorter than the radiation interval, there would, by implication, be other optical micropulses that are not part of that optical macropulse. Such other optical micropulses could belong to one or more other optical macropulses, or could be such isolated orphan optical micropulses.

Embodiments of the invention exploit the ability of the pump laser's optical micropulses incident on the optical cavity to coherently reinforce the circulating optical micropulses in the optical cavity. Coherent reinforcement can be achieved by ensuring that the time pattern of injected optical micropulses includes one or more optical macropulses, each of which is characterized by one or more optical micropulse spacings, and each of which is substantially an exact integral multiple m (including 1×, i.e., including m=1) of the RTTT. The optical frequency is substantially an exact integral multiple, n, of the inverse of the RTTT (scaled by c), and so the optical frequency should be n divided by (m times the RTTT). As mentioned above, multiple series with different periods or the same period can be interleaved.

Each optical micropulse, once injected into the cavity, circulates in the cavity, and each subsequent optical micropulse of the same optical macropulse injected into the cavity coherently reinforces the circulating micropulse that arose from earlier optical micropulses in the given optical macropulse. It is seen that operation of the invention in one aspect requires the injection of a number of micropulses of power adequate to achieve stored optical micropulses with normalized vector potentials of the order of 0.1 or more, while limiting the macropulse duration and hence the number of injected micropulses to values consistent with the integrated pulse and average power damage thresholds for the interior surfaces of the cavity.

By way of example, the optical micropulse duration may be on the order of 1-10 ps (picoseconds) while the optical micropulse repetition rate will typically be in the GHz range (say 1 GHz [L-band] to 10 GHz [X-band]; 2.86 GHz in a specific example). The radiation interval duration may be on the order of 1-10 μsec (microseconds) and the radiation interval repetition rate may be on the order of 10-100 Hz or lower or higher. This corresponds to micropulse duty cycles in the range of 0.1-0.001, and radiation interval duty cycles in the range of 0.00001-0.001. Thus the terms "radiation interval," "macropulse," and "micropulse" are used in a relative sense. In the specific example, the radiation interval duration, and the typical optical macropulse width, are on the order of microseconds and the optical micropulse width is on the order of picoseconds.

Assuming the use of either a single pump laser that can be programmed to change its lasing wavelength and/or optical macropulse timing on a shot to shot basis, or multiple pump lasers that can be triggered to produce overlapping or staggered optical macropulses, the invention also provides the means to change the x-ray wavelength at will from shot to shot, to alternate x-ray beams of differing, arbitrarily tunable wavelengths, or to simultaneously generate x-ray beams of multiple wavelengths during the same radiation interval or for separate radiation intervals.

These capabilities could be of decisive importance in the analysis of systems and structures whose properties change dynamically with time so as to require exposures at a number of wavelengths on a millisecond, microsecond, or picosecond time scale to capture transient features that might not survive long enough to be imaged using more conventional x-ray sources such as the permanent magnet undulator sources now in use at the major synchrotron radiation laboratories.

By incorporating an optical undulator with normalized vector potentials of the order of $a_n$~0.1 and greater but with a spatial period of the order of a micron, the invention described herein can be operated with both undulators and e-beam accelerators of dramatically reduced size and cost, permitting high performance ultraviolet and x-ray light sources to be constructed and operated at a fraction of the cost heretofore possible.

While many embodiments will have each electron micropulse interact with one of the circulating optical micropulses, there is no requirement that a circulating optical micropulse interact with an electron micropulse on every pass of the circulating optical micropulse. Similarly, there is no requirement that every electron micropulse interact with a circulating optical micropulse in the cavity. This might indeed be the case where a single electron beam is shared by multiple optical cavities. Also, note that orphan optical micropulses are unlikely to be timed to interact with electron micropulses.

Although specific embodiments of the invention described herein are directed towards generating x-rays, other embodiments can generate electromagnetic radiation in other wavelength ranges such as EUV and gamma rays. The term energetic electromagnetic radiation will be used to mean electromagnetic radiation having wavelengths shorter than 100 nm, which would include far UV, extreme UV (EUV), x-rays, and gamma rays. Much of the description is in terms of x-rays, but it should be understood that the other forms of energetic electromagnetic radiation are to be included unless the context suggests otherwise.

A further understanding of the nature and advantages of the present invention may be realized by reference to the remaining portions of the specification and the drawings.

DESCRIPTION OF SPECIFIC EMBODIMENTS

Basic Configuration and Operation

In brief, embodiments of the present invention enable the generation of x-rays and other energetic electromagnetic radiation (short wavelengths including ultraviolet and gamma rays). These embodiments can provide the bright, near-monochromatic, high average-power and peak-power x-ray beams required for x-ray crystallography, medical radiography and radiotherapy and other x-ray and gamma ray imaging systems, and for research in nuclear and high energy physics.

Figure 1A:
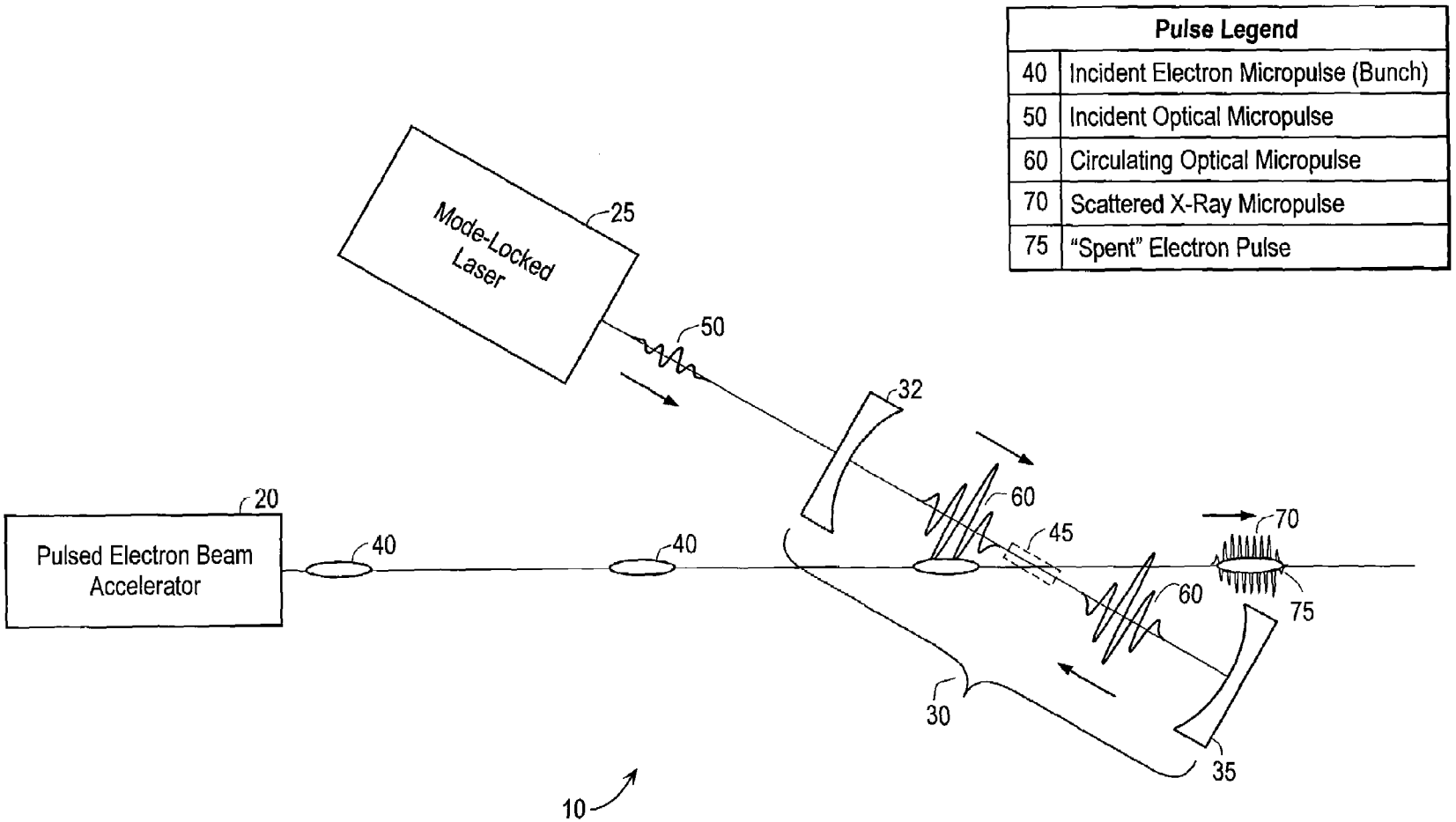
FIG. 1A is a high-level schematic of a system according to an embodiment of the present invention, and shows schematically the interaction of incident electron micropulses (bunches) with circulating optical micropulses in the cavity's interaction region.

FIG. 1A is a high-level schematic of the primary elements of a representative system 10 according to an embodiment of the present invention. The primary elements of the system include an electron source such as a pulsed electron beam accelerator 20, a pulsed light source such as a mode-locked pump laser 25 (or multiple pump lasers), and an optical cavity 30, which is operated as an optical resonator. Cavity 30 is shown schematically as including opposed concave mirrors 32 and 35. In brief, a series of focused electron micropulses 40 from accelerator 20 are caused to interact with an optical undulator field at an interaction region 45 in cavity 30 to generate energetic electromagnetic radiation.

The undulator field is preferably established by injecting radiation 50 from laser 25 into cavity 30 to establish one or more circulating optical micropulses 50 in the cavity. The laser radiation is sometimes referred to as the laser beam. The cavity is configured to focus the circulating optical micropulse(s) at interaction region 45. As will be described in greater detail below, optical micropulses in the incident radiation are spaced and synchronized so that the circulating optical micropulse is coherently reinforced by subsequent optical micropulses in the incident radiation. The product of such interaction is a scattered x-ray (or other energetic electromagnetic radiation) micropulse 70, and an electron micropulse 75 at reduced energy.

Figure 1B:
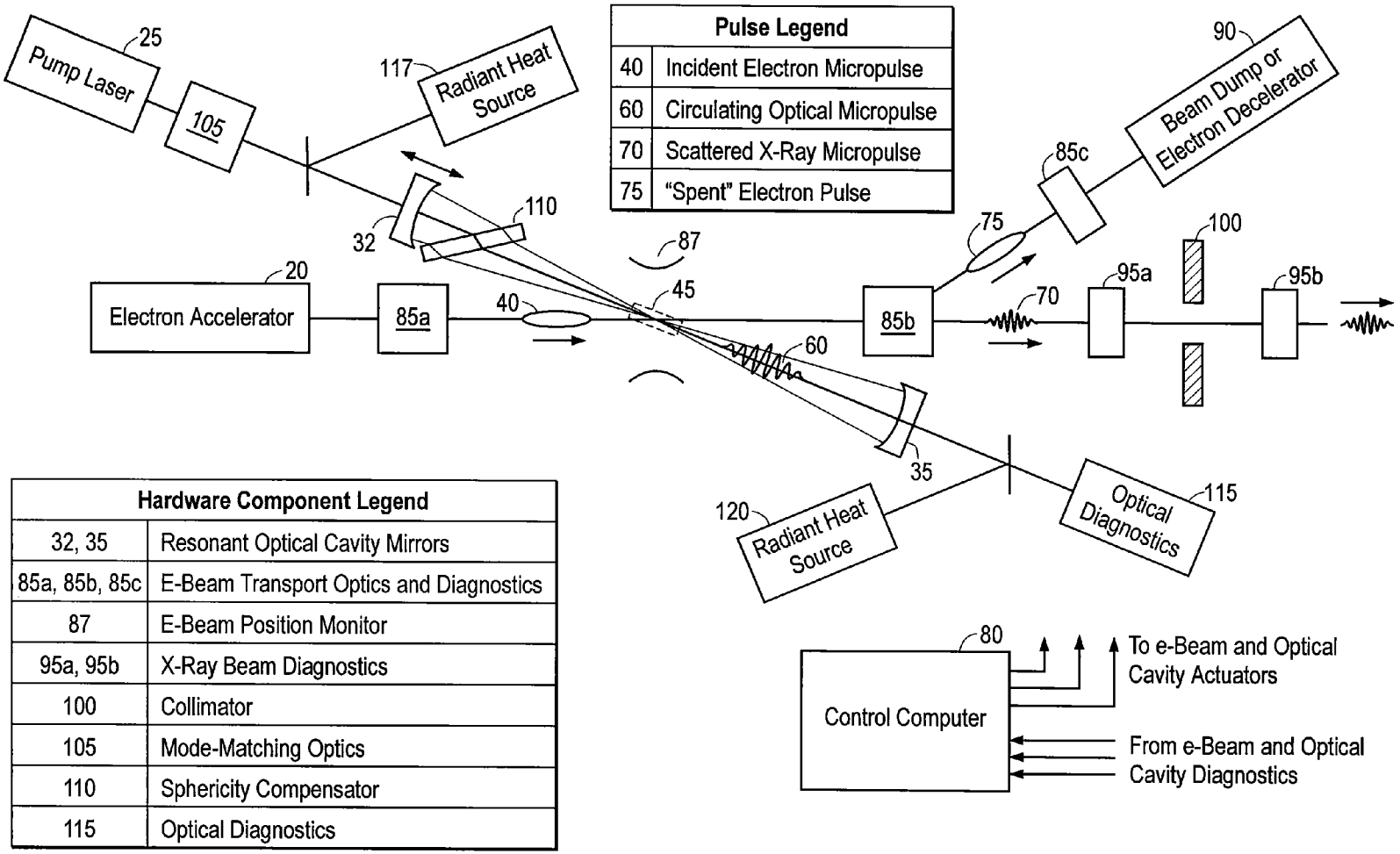
FIG. 1B is a more comprehensive schematic of the system shown in FIG. 1A.

FIG. 1B is a more comprehensive schematic of the system shown in FIG. 1A. As mentioned above, the system operates to generate bright, coherent, monochromatic x-rays (or other energetic electromagnetic radiation) by colliding electron micropulses 40 from electron accelerator 20 with one or more intense, coherent optical micropulses 60 stored in optical cavity 30 (shown schematically as concave mirrors 32 and 35). X-ray generation is localized in interaction region 45 where the vector potential of the optical micropulse is controlled to maintain a value of $a_n$ greater than ~0.1.

The system includes a number of control and feedback elements that are connected to a control computer 80. The electron beam control includes e-beam transport optics and diagnostics 85*a*, 85*b*, and 85*c*, and a beam position monitor 87. The electron bunches from electron accelerator 20 are directed through e-beam transport optics and diagnostics 85*a* to interaction region 45 under the control of beam position monitor 87, and then removed from the output beam by e-beam transport optics and diagnostics 85*b*, and directed by e-beam transport optics and diagnostics 85*c* into a decelerating beam dump 90.

The generated x-ray micropulses are directed through x-ray beam diagnostic elements 95*a* and 95*b*, between which is disposed a collimator 100, to the x-ray experiment or other entity that is to make use of the x-rays.

The optical beam control includes transport and mode-matching optics 105, a sphericity compensator 110 (shown as a tilted plate for this particular cavity embodiment), one or more optical diagnostic elements 115, and a pair of radiant heat sources 117 and 120. The optical micropulses generated by pump laser 25 (or multiple pump lasers) are directed through transport and mode-matching optics 105 into optical cavity 30. Sphericity compensator 110 is incorporated into the cavity optics to ensure that a tight focus in interaction region 45 can be achieved simultaneously with coherent pulse stacking in the optical cavity. The mode quality and intensity of the optical micropulses circulating within optical cavity 30 are monitored by optical diagnostic element(s) 115. Radiant heat sources 117 and 120 are directed to cavity mirrors 32 and 37 via respective beam-splitters 122 and 125 to compensate the thermal effects of the stored beam. This additional level of geometric control of optical cavity 30 helps to maintain the required optical vector potential $a_n$ in interaction region 45.

Signals from e-beam transport optics and diagnostic elements 85*a*, 85*b*, and 85*c*, beam position monitor 87, x-ray beam diagnostic elements 95*a* and 95*b*, and optical diagnostic element(s) 115 are sent to control computer 80, which uses these signals to control e-beam transport optics and diagnostics 85*a*, 85*b*, and 85*c*, transport and mode-matching optics 105, sphericity compensator 110, and radiant heat sources 117 and 120.

Figure 2A:
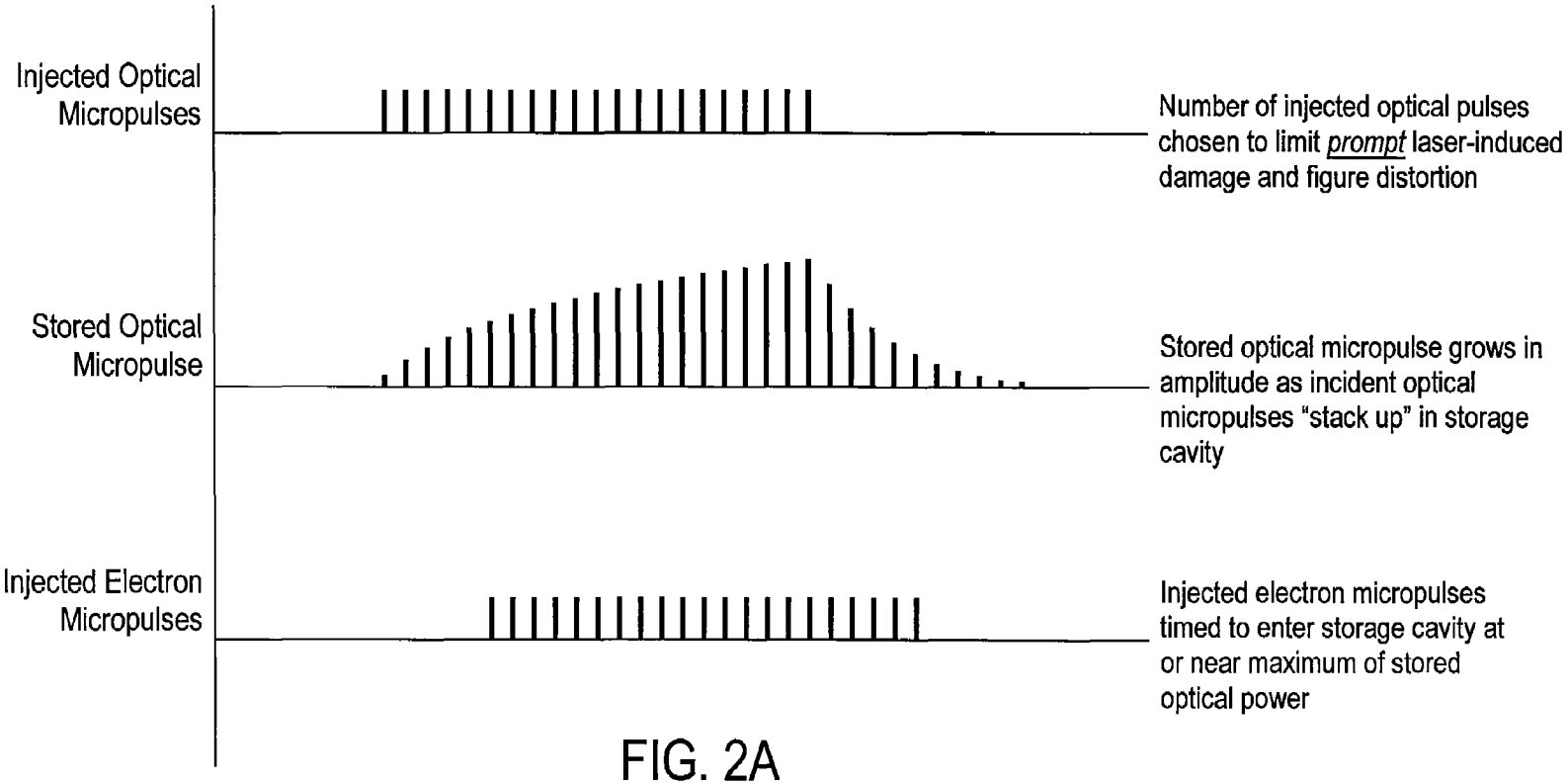
FIG. 2A is a timing diagram showing (a) a representative optical macropulse containing a series of optical micropulses, (b) the manner in which the amplitude of the circulating optical micropulses grows as incident optical micropulses coherently reinforce the circulating optical micropulse in the optical cavity, and (c) a representative electron macropulse where the injected electron micropulses are timed to enter the optical cavity at or near maxima of the stored optical power in the cavity.

FIG. 2A is a timing diagram showing schematically some of the timing relationships for the case of a given circulating optical micropulse during the operation of the system of FIGS. 1A and 1B. Details of the micropulse timing will be discussed below, but at this point it is noted that the overall time profile of the incident radiation includes a series of spaced optical macropulses, each of which includes a series of optical micropulses. As the term "optical macropulse" is used in this application, the optical micropulses that make up an optical macropulse give rise to one circulating optical micropulse. In some embodiments, multiple optical macropulses can be superimposed to give rise to multiple corresponding circulating optical micropulses.

The top portion of FIG. 2A shows a representative optical macropulse containing a series of optical micropulses. The middle portion of FIG. 2A shows the manner in which the amplitude of a circulating optical micropulse grows as incident (injected) optical micropulses coherently reinforce the circulating optical micropulse in the optical cavity. This can be referred to as the incident optical micropulses "stacking up" in the cavity. The bottom portion of FIG. 2A shows a representative electron macropulse where the injected electron micropulses are timed to enter the optical cavity at or near maxima of the stored optical power in the cavity.

Figure 2B:
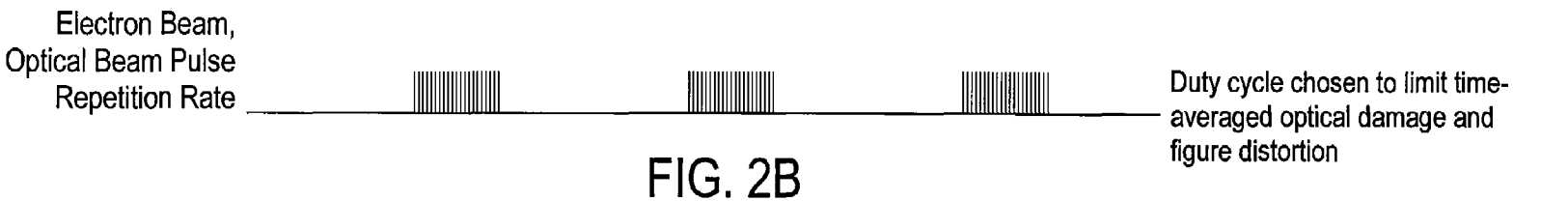
FIG. 2B shows representative electron beam and laser beam macropulse timing where the duty cycle of the radiation interval is chosen to limit time-averaged damage and figure distortion.

FIG. 2B shows representative optical and electron timing. The injected electron micropulses are timed to enter the optical cavity at or near maxima of the stored optical power in the cavity. The number of injected optical micropulses in a macropulse is chosen to limit prompt thermal-induced damage to the cavity. The duty cycle is chosen to limit time-averaged damage and uncompensated figure distortion.

Figure 3A:
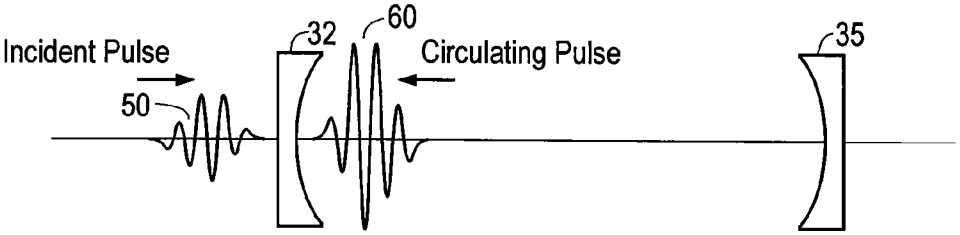
FIGS. 3A and 3B show schematically the notion of optical phase coherence, with FIG. 3A showing an incident optical micropulse approaching a cavity mirror from the left and a circulating optical micropulse approaching the cavity mirror from the right, and FIG. 3B showing portions of the incident and circulating optical micropulses reflected by and transmitted through the cavity mirror.
Figure 3B:
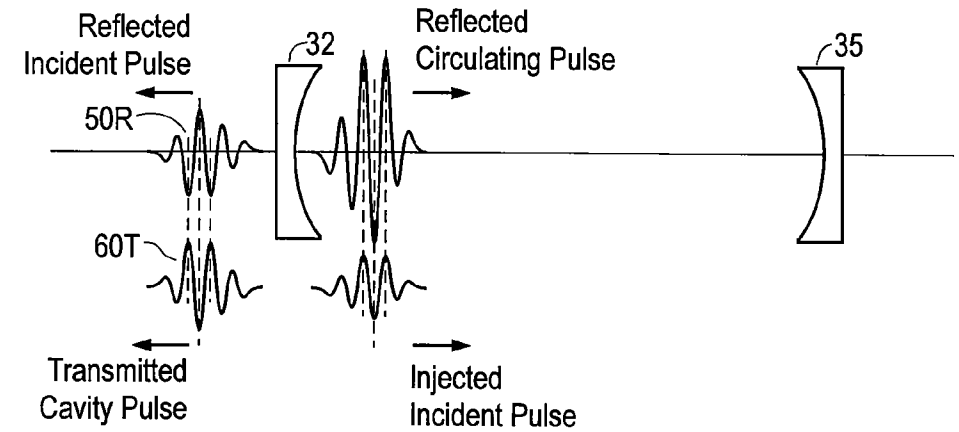

FIGS. 3A and 3B show schematically the notion of optical phase coherence. FIG. 3A shows an incident optical micropulse approaching a cavity mirror from the left and a circulating optical micropulse approaching the cavity mirror from the right. FIG. 3B shows the general case where:

(a) a portion of the incident optical micropulse is transmitted through the cavity mirror into the cavity and a portion of the circulating optical micropulse is reflected (with inversion) by the cavity mirror; and (b) a portion of the incident optical micropulse is reflected (with inversion) by the cavity mirror and a portion of the circulating optical micropulse is transmitted through the cavity mirror.

If the microscopic (optical) phase and the envelope of the injected optical micropulse substantially match the microscopic (optical) phase and the envelope of the circulating optical micropulse as illustrated, this will result in:

(a) the amplitudes of the portion of the incident optical micropulse that is transmitted by the cavity mirror will add coherently to the portion of the circulating optical micropulse that is reflected by the cavity mirror; and (b) the amplitudes of the portion of the incident optical micropulse that is reflected by the cavity mirror and the portion of the circulating optical micropulse that is transmitted through the cavity mirror will cancel (i.e., add destructively) outside the cavity.

Physics Underlying Operation of the Invention

A relativistic electron deflected by a spatially periodic transverse magnetic or electromagnetic field radiates electromagnetic energy at a rate proportional to the product $\gamma^2k^2A^2$, where $\gamma$ is the Lorentz factor $E/mc^2$, k is the wavenumber $2\pi/\lambda$ specifying the period $\lambda$ of the field's spatial oscillations, and A is the rms vector potential.

It is also useful to define a normalized vector potential $a_n$ where $a_n=eA/mc^2$ in cgs units.

If the transverse magnetic field is periodic, the emitted radiation is peaked in the forward direction (i.e., the axis parallel to the electron's direction of motion at the wavelength $(1+a_n^2)\lambda/(1+\beta\cos\theta)\gamma^2$ if the field is static. If the field is a traveling plane wave, the emitted radiation is peaked in the forward direction at the wavelength $(1+a_n^2)\lambda/2(1+\beta\cos\theta)\gamma^2$, where $\theta$ is the angle at which the axis of the optical cavity is displaced from the forward direction of the electron beam. This process has lent itself in the case of static fields to the generation of intense, highly collimated beams of nearly monochromatic x-radiation for applications such as x-ray crystallography, and has led to the construction of a large number of very large and expensive accelerator-based x-ray sources to serve these applications.

For both the cases of static and time-varying fields, the energy radiated by the electrons in these sources continues to increase with increasing field strength as the square of the vector potential. While ever more energy is radiated at large fields ($a_n$>>1), the radiation is emitted at longer wavelength. The radiation emitted at high fields ($a_n$>>1) is also no longer monochromatic, but includes an increasing number of harmonics degenerating ultimately to a nearly white-light spectrum (Elleaume 2003 and Lau 2003).

The qualitative evolution of the spectrum of the undulator radiation with increasing values of the normalized vector potential thus offers designers and users of systems based on these principles the opportunity to optimize the design to match the application (Kim 1989). For applications emphasizing monochromaticity and low harmonic content, the system can be designed to operate at the lower values of $a_n$ in the range of $0.1<a_n<0.5$, while the features of operation at the higher values of vector potential can be usefully exploited to generate beams of higher power and photon flux including a broader range of harmonically related wavelengths converging to near-continuum white-light radiation for $a_n$>>1 (say 3 or more) for applications such as x-ray lithography.

The dependence of the radiated energy on wavenumber, vector potential and electron energy at fixed emission wavelength indicates that the radiated energy can be increased only by reducing the period $\lambda$ of the magnetic or electromagnetic field. This result establishes the general conclusion that the maximization of the radiated power requires the minimization of undulator period. The techniques of the present invention permit the reduction of the undulator period $\lambda$ from the range of 1-10 cm currently used in e-beam-based x-ray sources to the optical region, e.g., to values of $\lambda$ of the order of a micron, smaller by four orders of magnitude.

The reduction in undulator period made possible by this invention thereby increases the radiated energy per unit length of the undulator by at least four orders of magnitude while simultaneously reducing the size and cost of the electron accelerator required for operation, making possible the construction of compact, inexpensive, high performance x-ray and gamma ray light sources for use in x-ray crystallography, medical radiography and radiotherapy, advanced x-ray and gamma ray imaging systems, and scientific research in nuclear and high energy physics.

The creation and maintenance of such tightly focused, energetic optical pulses require that the fluence and peak power density incident on the optical surfaces of the cavity be consistent with the damage ratings of the substrates and coatings used to construct the cavity, that the figure and spacing of the cavity mirrors be controlled to maintain the focus required for operation, and that the spacing and optical phase of the optical pulses generated by the pulsed pump laser remain precisely synchronized with the accumulated optical pulses in the cavity cavity.

Optical Micropulse Characteristics

To fulfill these very demanding constraints, the invention described herein utilizes an optical undulator created by accumulating the picosecond, synchronized, phase-coherent optical pulses from one or more low average power pulsed lasers in the matching modes of a high finesse, near-spherical optical cavity to exploit the capability of such cavities to bring the circulating optical pulses to a focus on the order of the optical wavelength while maintaining cm-scale spot sizes on the mirrors. In this manner, optical cavities can be constructed in which the vector potential at the focus approaches unity while maintaining the peak power density and fluence at the surfaces of the components of the cavity consistent with stable and reliable operation.

But even allowing for the reduction in peak optical power density at the optical surfaces of such cavities, the average optical power densities at the optical surfaces can still result in damage or degradation due to melting, diffusion or decomposition of the coating and/or substrate materials and figure distortion due to the macropulse average and/or time-averaged power dissipated in the coatings and substrates of the cavity components. Accordingly, functional optical undulators cannot rely only on cavity geometry, but should also incorporate one or more techniques to suppress these optical damage mechanisms while preserving the conditions required for light source operation.

Accordingly, embodiments of the invention incorporate a time structure for the optical micropulses circulating in the cavity that provides the desired high vector potential while protecting the cavity components from damage. At the optical micropulse level, the circulating optical micropulses are of sufficiently limited duration and peak power when they encounter the cavity components so as to limit the development of avalanche breakdown on the picosecond time scale. At the radiation interval level, the number of optical micropulses in a radiation interval is restricted to limit the peak temperature rise of the coatings and surfaces of the optical elements components of the cavity.

Additionally, the repetition rate of the successive radiation intervals is limited to keep the thermal stress and thermal distortion of the optical elements used in construction of the cavity to manageable values. In this context, "manageable values" means values that can be compensated by regulating substrate temperature gradients or by adjusting mirror spacing, pump laser frequency and picosecond pulse to maintain the conditions required for operation of the source.

Given the creation of an optical field capable of operation at values of the normalized vector potential $a_n$~0.1-1.0, intense, collimated, near-monochromatic beams of x-rays are produced in the invention by directing a tightly focused, bunched, pulsed electron beam through the stored optical pulse at its focus within the cavity cavity. When coupled to an appropriate e-beam source, an optical undulator so constructed and operated makes possible the generation of this radiation at electron energies a factor of 100 lower than possible using existing undulator technology at the lowest possible average electron current and power required for a specified value of x-ray power output.

The instantaneous peak power of the x-ray beam generated by this system is determined by the number of radiated x-rays/electron as determined by $a_n^2$ and $\gamma$, by the average number of electrons per bunch as determined by the peak electron current and bunch length, and by the bunch spacing. The average x-ray power generated by the invention is limited only by the average power rating of the surfaces and substrates used in the optical cavity, and the limitations, if any, on the repetition rate for the accelerator used to provide the electron beam required for operation.

Assumption of representative values for the presently attainable optical damage thresholds and accelerator peak and average currents yields x-ray beam brightnesses comparable to the current state of the art for sources using cm-period undulators, but with far smaller size and cost due to the reduced size of the accelerator and undulator systems required for operation. It can further be seen that using a picosecond pulsed optical beam to create the circulating optical micropulses makes it possible to achieve far larger values of the normalized vector potential and radiated x-ray power than would be possible by using a continuous optical beam limited by the same constraints on optical power density and average optical power at the surfaces of the mirrors.

Pump Laser Characteristics

The optical radiation required for operation of the invention is generated by one or more repetitively pulsed, phase-coherent laser sources whose optical micropulses vary in phase and amplitude with a period equal to integral multiples of the round-trip transit time of the optical pulses circulating in the cavity. Although such lasers are generally incapable of directly attaining the peak power required for use as an optical undulator, the repetitive pulses obtained from even low power phase-coherent laser sources can be integrated in appropriately designed low-loss optical storage cavities to achieve peak powers within the cavities exceeding the laser output power by at least 3 orders of magnitude.

The condition on the periodicity of the phases of each train of injected micropulses allows, in principle, the use of lasing frequencies (the reciprocal of the period between zero-crossings of the electric field) which are not equal to an eigenfrequency of the optical storage cavity without significant impact on operation given the limited number of optical cycles in each optical micropulse. However, the relaxation of the criteria for frequency synchronization normally applicable to optical storage cavities driven with CW lasers does not alter the requirement in the present invention that the optical phase of the injected pulses must be periodic with the same period as their spacing in time and equal to an integral multiple of the cavity round trip transit time.

Given these constraints, the optical frequencies of the pulses to be injected into the storage cavity must be set equal to either to an individual or combination of the frequencies $\nu_{nm}=n/(m\tau)$ where $\tau$ is the round trip transit time (sometimes referred to as the RTTT) for the cavity, m is an integer defining the time interval between the injected micropulses in terms of $\tau$, and n an integer defining the ratio of the optical frequency to $1/(m\tau)$.

Given the conditions to be satisfied by the periodicity of the phase and amplitude of the micropulses injected into the cavity cavity, it is expressly possible to simultaneously pump the cavity with a multiplicity of optical pulse trains of differing lasing and micropulse repetition frequencies, and arbitrary timing relative to each other, provided only that each optical pulse train satisfies the aforementioned condition on the periodicity of its variations in amplitude and phase.

Possible laser sources for use with such an optical storage cavity include the broadband pulsed diode lasers used for optical communications, pulsed fiber optic lasers, and phase-locked free-electron lasers. By placing the active lasing medium outside the optical storage cavity, it is possible both to use a broader range of lasing media and to operate these lasing media under more nearly optimal conditions than those necessarily present within the storage cavity, thereby generating stored optical micropulses with more nearly optimal normalized vector potentials.

If one or more free-electron lasers (FELs) are integrated as part of the invention to pump the optical cavities, these FELs can be set up to use a common linac injector, or to use a common linac injector for both FEL operation and operation of the optimized undulator x-ray sources of this invention.

Although the picosecond pulse structure used for operation of the optical undulator according to embodiments of this invention is generally compatible with the capabilities of both pulsed phase-coherent pump lasers and microwave or radio frequency electron accelerators, the conditions for synchronization of the laser frequency and pulse spacing of the laser, and the phase and pulse spacing of the electron bunches produced by the accelerator to be used with the system, require precise matching of the accelerator and laser operating frequencies with the dimensions of the optical storage cavity.

The synchronization of the periodicities of the optical pulse trains provided by the pulsed pump laser and the round trip transit time of the cavity cavity is set and maintained either by adjusting the longitudinal positions of the mirrors to maintain the transit time at an appropriate value or by modulating the optical wavelength and pulse period of the pump laser to track the changes in the cavity dimensions and focal parameters. If the lasing frequency and micropulse repetition frequency of the pump laser are altered during operation, the operating frequency of the accelerator is changed accordingly to maintain synchronization. No change in the laser and accelerator frequencies is required if the round trip transit time for the optical cavity is maintained at a constant value during operation.

Consideration of the effect of jitter in the phase of the injected micropulses and the timing of their envelopes on their coupling to and reinforcement of the circulating micropulse(s) in the optical cavity indicate that to insure efficient injection the phase of the injected micropulses are preferably maintained within ±20° of the phase of the circulating stored micropulse, while the temporal width and time of arrival of the envelopes of the injected micropulses are preferably regulated to within 10% of the width of the circulating optical micropulse(s).

If the phase and timing of the injected optical micropulses can not be maintained to within these limits, it will be necessary to increase the power of the injected micropulses to raise the vector potential of the circulating micropulses to the levels required for operation of the system. Greater phase jitter, out to a limit on the order of ±45°, and/or greater timing jitter on the order of ±50% of the optical micropulse duration can thus be tolerated, but at the cost of lower injection efficiency and higher injected optical micropulse power for the same value of $a_n$. Embodiments with phase jitter and/or timing jitter in these expanded ranges would still be considered to provide coherent reinforcement by the incident optical micropulses.

Given the extreme sensitivity of the system to small mismatches in lasing, optical micropulse, accelerator and cavity periodicities in the time domain, and to the dimensions that affect these periodicities, the synchronization of frequencies and/or periodicities needed to ensure effective and stable operation will require in most practical systems inclusion of the sensors and diagnostics needed to measure and compare these periodicities, and to adjust the frequencies of operation and/or the dimensions of the elements to be adjusted as required under closed loop feedback control.

Multiple Laser Embodiments

Figure 4:
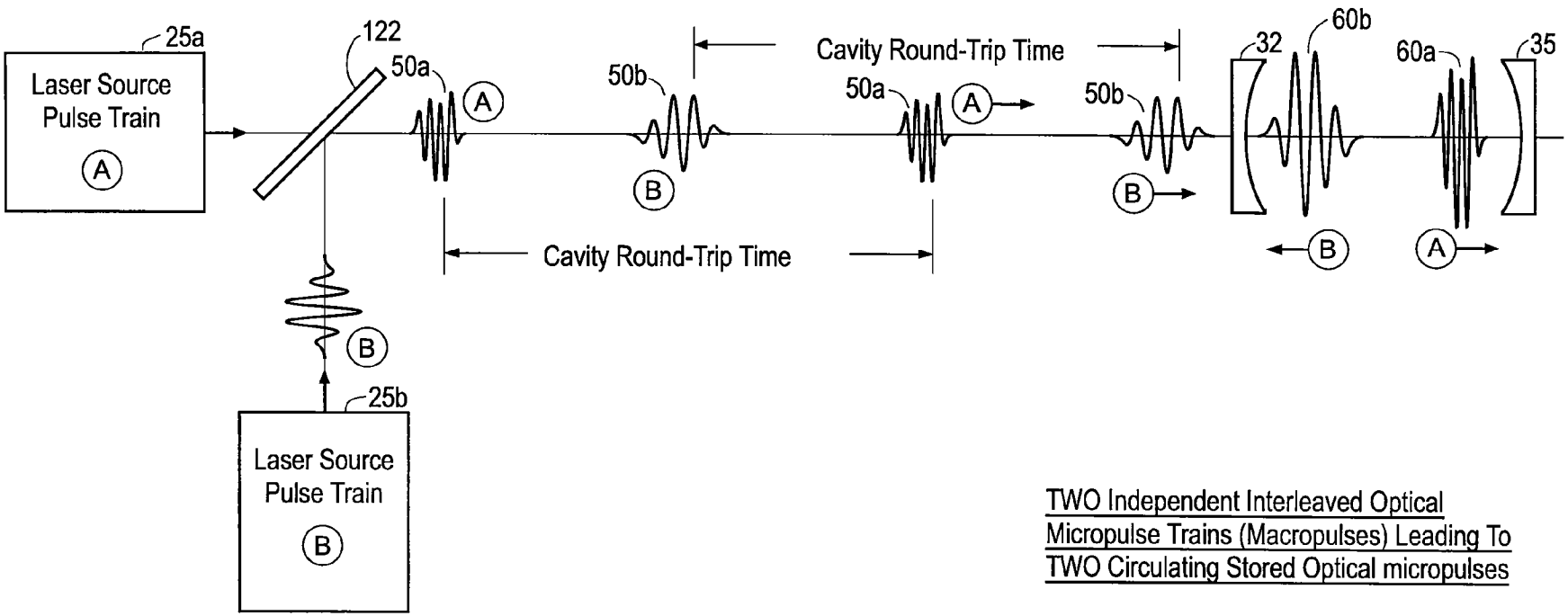
FIG. 4 shows schematically optical micropulses from two separate lasers being used to establish two circulating optical micropulses.

FIG. 4 is a schematic showing an embodiment where optical micropulses from two separate lasers 25*a* and 25*b* are used to establish respective single circulating optical micropulses 60*a* and 60*b*. As illustrated, the lasers provide respective trains of incident optical micropulses 50*a* and 50*b* separated by the cavity round-trip transit time, which is consistent with each laser generating a single optical macropulse (as opposed to providing interleaved macropulses). These beams are combined at a beam combiner 122 prior to introduction into the cavity, although in principle the two laser beams could be introduced into opposite ends of the cavity.

The drawing also shows the optical micropulses of one laser's optical macropulse centered between the optical micropulses of the other laser's optical macropulse. In order to accommodate pulse stacking, there is no required relationship of the timing of one laser's optical micropulses with respect to the other laser's optical micropulses. Thus, the spacing of an interlaced pair of optical macropulses could therefore be a-periodic, with a pair of the optical micropulses closely spaced, followed by a gap, followed by another pair of closely spaced optical micropulses, so long as all of the spacings corresponded to an integral multiple of the spacing of the accelerated electron micropulses.

However, if the cavity is to be used with an electron accelerator producing a single periodic train of electron micropulses, the interlaced optical macropulses would also have to be spaced from each other by an integral fraction ($\tau/n$) of the round trip time $\tau$, or else the circulating optical micropulses would not collide with the electron micropulses. Since most or all current electron accelerators use an RF resonance of some kind to generate the high electric fields needed to accelerate the electron micropulses (bunches) most practical embodiments of the invention would be constrained by the fact that the electron micropulses are delivered periodically at some defined frequency.

Electron Beam Characteristics

The electron beam used in the invention is provided by one or more RF or microwave accelerators, each of which generates an extended series of electron bunches (each preferably subtending no more than 10 degrees in RF phase and spaced by the period of the accelerator's operating frequency or an integral multiple thereof). Possible sources of such beams include RF or microwave linear accelerators, microtrons or storage rings. A representative embodiment uses one or more 10-30 MeV electron linear accelerators, each employing a thermionic microwave gun operating at 3 GHz to produce the high average current bunched electron beam.

The electron beam generated by each accelerator is focused to a waist in both the horizontal and vertical planes in the region in which that electron beam collides with the optical radiation. The dimensions of the focal spot are chosen to minimize the e-beam's spatial cross section while constraining the electrons' angular spread to a value yielding an acceptable x-ray spectral bandwidth. Operation of the system generally requires as low an e-beam emittance as possible to achieve the smallest beam focus consistent with the constraints imposed by the x-ray spectral brightness on the angular spread.

Following the electrons' passage through the optical undulator, the emerging electron beam(s) can either be re-focused for use in one or more subsequent and independent interaction regions similar to the first, recirculated in a storage ring, transported to a beam dump for disposal, or transported to a second set of one or more RF or microwave accelerator phased to extract the energy of the spent electrons as RF or microwave power instead of heat and ionizing radiation. In a representative embodiment, a second accelerator section of similar length to the accelerator generating the beam that is transported to the optical undulator is dephased by 180 degrees to reduce the energy of the decelerated electrons to below 10 MeV for disposal in a conventional beam dump.

Cavity Characteristics

The design and operation of simple two-mirror optical storage cavities have been reviewed extensively in the scientific literature (Siegman 1996a) and cavities of this type are already in use with CW laser sources to provide the very fine "optical wires" (Sakai 2001) to measure the cross section of the high energy low emittance electron beams used in single-pass linear colliders for research in high energy physics. The prior art has also addressed the need to adjust the mode-locking frequency to match the eigenmode spacing to optimize the efficiency of injection and the amplitude of the stored pulses when using a mode-locked pump for pulse stacking (Jones 2001).

However, while such optical storage cavities have been developed and demonstrated in the prior art either for the purpose of pulse stacking (using a pulsed pump source) or for the generation of an intense narrow focal spot (using a CW pump source), the capability to achieve both efficient pulse stacking and a prescribed narrow focal spot, simultaneously in a single storage cavity, requires a special cavity design which is not described in the prior art. For example, the cavity used to construct the single-mode, CW "optical wire" in the prior art provides no constraint on the round-trip transit time, and so is singularly unsuited for use with a pulsed laser source whose micropulse repetition frequency is precisely matched to this spacing to achieve efficient multimode operation.

The prior art has also provided no guidance as to the means available to practically fabricate the optical elements required for construction and operation of the optical cavity cavity incorporated as part of the invention. While the design and construction of cavity cavities designed for injection and accumulation of CW and phase-coherent pulsed laser beams have been discussed at length in the literature (Sakai 2001 and Jones 2001), the prior art provides no guidance as to the practical means available to construct cavities that can simultaneously satisfy the very demanding criteria for efficient accumulation and storage and for creation and maintenance of the narrow focus required for realization of a useful optical undulator.

The cavity cavity on which this invention relies achieves the simultaneous capability to focus the circulating optical pulses to the smallest spot permitted by diffraction, while maintaining the spectrum of cavity eigenmodes and cavity round-trip transit times and cavity losses required for operation, by circumventing the limitations inherent in the fabrication of curved reflecting surfaces. The central problem to be addressed is that it is essentially impossible to polish and figure a mirror surface so that its center of curvature is prescribed with an error of less than 0.1% or so of its radius of curvature, corresponding to an absolute uncertainty of several hundreds of microns in the position of the centers of curvature for the mirrors required in practical embodiments of the storage cavity in the present invention.

This uncertainty is insufficient for the present application, for which an uncertainty on the order of several microns must be achieved simultaneously both in the mirror separation, to provide efficient pulse stacking, and in the spatial locations of the centers of curvature of the mirrors, to independently achieve a tight focus at the waist. In the prior art, only one or the other of these conditions could be achieved, but not both. However, aspects of the present invention provides construction and capabilities of the optical cavity used to accumulate the optical pulses injected by the pump laser, capabilities that are not found in the prior art.

Cavity Design

In two-mirror cavity cavities the attainment of the minimum focal spot size and specified round-trip transit time requires either greater than practically attainable precision in the fabrication of mirrors or a mechanism to deform the mirrors to force their surfaces to conform to the required figures, a procedure that may also lead to unacceptable levels of internal stress. It is therefore generally preferable to add a third element to the cavity that can be fabricated and placed to compensate for the inevitable errors in fabrication of the cavity cavity's two primary mirrors. Accordingly, the possible designs for the optical storage cavity used in the present invention circumvent the above limitations in mirror fabrication by providing techniques to transfer the required precision to another optical element whose corresponding precision can be achieved in fabrication, or to appropriately adjust the cavity parameters in operation. At least two such generic three-element cavity configurations can be realized.

First Cavity Configuration

Figure 5:
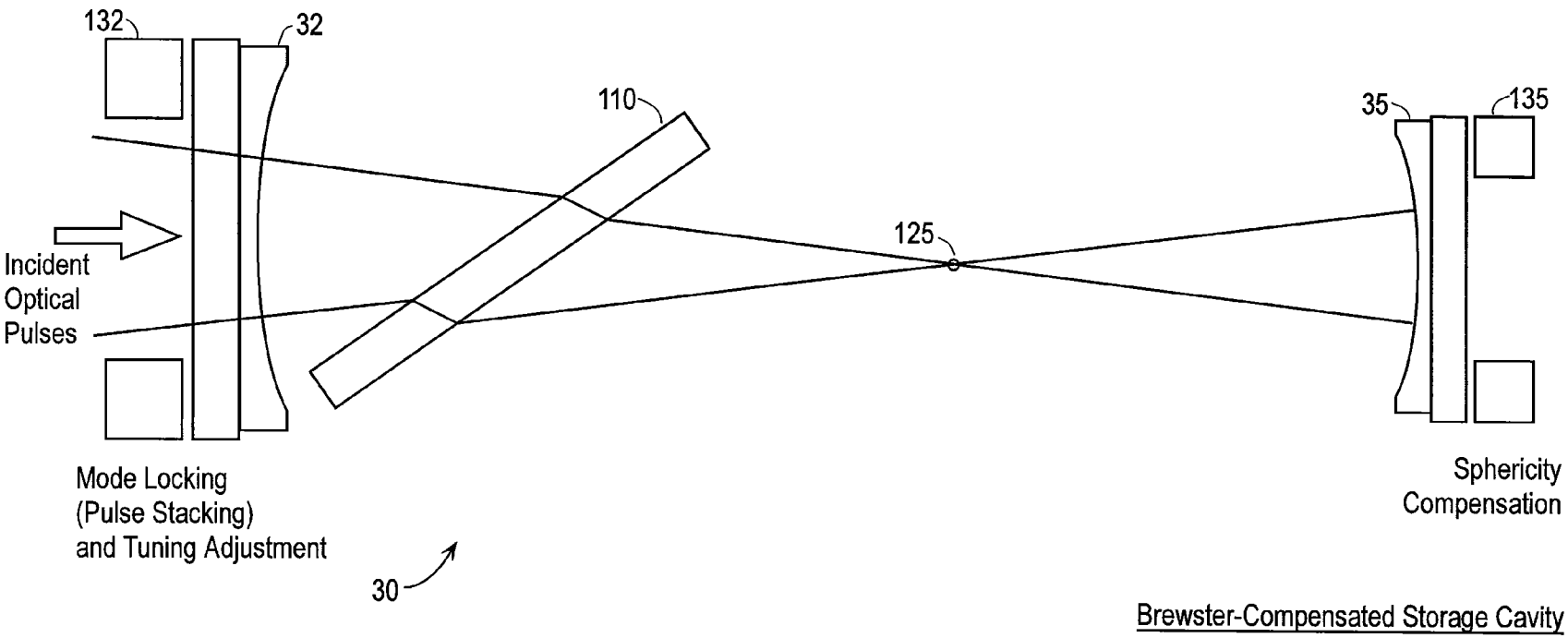
FIG. 5 is a schematic of a first configuration of an optical cavity suitable for practicing embodiments of the present invention.

FIG. 5 is a schematic of a first configuration of optical cavity 30 suitable for practicing embodiments of the present invention. This configuration implements sphericity compensator 110 as a dielectric Brewster plate of finite thickness oriented at or near the Brewster angle for P-polarized light from the pump laser. The presence of the plate in the cavity has two effects: (i) it increases the round-trip transit time of the pulses in the cavity by a time delay which is directly proportional to the thickness of the plate; and (ii) it optically shifts the center of curvature of the closest mirror by a spatial displacement which is directly proportional to the thickness of the plate. The temporal and spatial displacements in (i) and (ii) are determined by independent physical properties of the plate, and therefore they can be independently prescribed in the design of the storage cavity. Optimum focusing of the circulating optical micropulses by the cavity occurs when the centers of curvature of the two mirrors, 32 and 35, are substantially coincident at a point, designated 125, which corresponds to the beam waist.

The proposed method for incorporating the plate into the cavity design is based on the following sequence of steps:

1) choose a nominal thickness, angle of incidence, and position in the cavity for the dielectric plate; the best choice for the nominal thickness of the plate is described in paragraph [0096] below;
2) calculate the physical mirror separation required for efficient pulse stacking, including the time delay introduced by the plate; this calculation yields a first equation involving the thickness of the plate;
3) calculate the radii of curvature of the mirrors, with spacing determined in (2), required to achieve the desired radius of the focal spot at the waist, including the spatial displacement introduced optically by the plate; this calculation yields a second equation involving the thickness of the plate;
4) manufacture the cavity mirrors with radii of curvature matching as closely as possible the radii determined in (3);

5) measure, by interferometric or other optical techniques, the actual radii of curvature of the mirrors produced in (4); the methods required to effect this measurement within an error of several microns can be found in the prior art; and
6) using the two independent equations involving the thickness of the plate from steps (2) and (3), and using the measured radii of curvature from step (5) as fixed parameters in these equations, solve these two equations for two new unknowns: i) the new thickness of the plate; and ii) the new physical mirror separation.

The original choice for the nominal thickness of the plate should be sufficient that, given the limits of uncertainty in the manufacturable radii of curvature of the mirrors [step (3)], the new thickness of the plate is sufficiently thick so as to be manufacturable with good flatness, and sufficiently thin so as to minimize spurious optical effects on cavity operation such as absorption or self-focusing;

In general, a tilted parallel plate will introduce astigmatism in a diverging or converging optical beam, leading in the present design to a stored optical beam with different focal radii in the "vertical" and "horizontal" (i.e., orthogonal transverse) directions. But this astigmatism can be compensated exactly by grinding a small wedge angle between the surfaces of the plate in the plane of incidence; the magnitude of the wedge angle can be determined by optical analytic techniques known to practitioners in the art.

The benefit of the above design approach arises from the fact that, in contrast to the difficulty of locating the centers of curvature of the two mirrors to an accuracy of several microns, the thickness of the plate can easily be ground and polished to an accuracy of several microns. Therefore, simultaneous optimization of the focal spot (via cavity sphericity) and pulse stacking, as required in the present invention, can be achieved in the above design.

In addition to compensating the error in the fabrication of the curved mirror surfaces, the Brewster plate could also be designed to compensate for thermal distortions of the mirror surfaces during operation, whose predominant effect is to alter the radius of curvature due to the spatial profile of the high-power stored optical beam. Such effects could in principle be calculated or measured to high precision using the known thermo-mechanical and optical properties of the mirror substrate. Alternatively the storage cavity could be designed to provide this compensation independently, for example, by using an external laser beam of variable power to back heat one or both of the mirrors, or by applying an adjustable mechanical stress to the mirrors at the back surface or at the edges to provide a compensating distortion. FIG. 1B shows two radiant heat sources 117 and 120 used for thermal compensation as one specific implementation.

Practical embodiments of the storage cavity may in fact have to compensate for such changes in the radius of curvature by these or other techniques. For example, if the nominal configuration of the storage cavity uses an external heat source applied to raise the temperature of the center of the mirror with no stored beam, then during operation the intensity of that source could be reduced as required to make up for the heating induced by the pump laser during operation. Similarly, an applied mechanical stress could be adjusted from its initial (empty-cavity) value to maintain the required radius of curvature during operation with a high-power stored beam.

FIG. 5 also shows additional positioning elements for controlling the sphericity and mode locking. In particular, a positioner 132 is shown as associated with concave mirror 32 and a positioner 135 with concave mirror 35. For example, these positioners could be implemented with both mechanical and electrical components to provide a rapid response to compensate any perturbations that might arise. For example, the mirrors could be mounted on stable mechanical flexures that constrained their translational motion to lie along a single axis, in which the motion was actually induced by respective piezoelectric actuators pushing on the flexures.

Note that in the basic design of FIG. 5, translating the mirror also changes the cavity length slightly and thus affects the pulse stacking. A technique which compensates the resonator sphericity in this design without translating the mirrors is to use laser backheating to change the radius of curvature of the mirror without changing the cavity length, as shown in FIG. 1B (radiant heat sources 117 and 120). It is possible in principle to compensate the sphericity using translational motion alone if the resulting changes in the cavity round trip time and resonant frequencies are fed back to the mode-locked, frequency-locked laser source and to the RF drive; the changes would generally be small enough to allow this, even in an RF linac FEL.

Second Cavity Configuration

Figure 6:
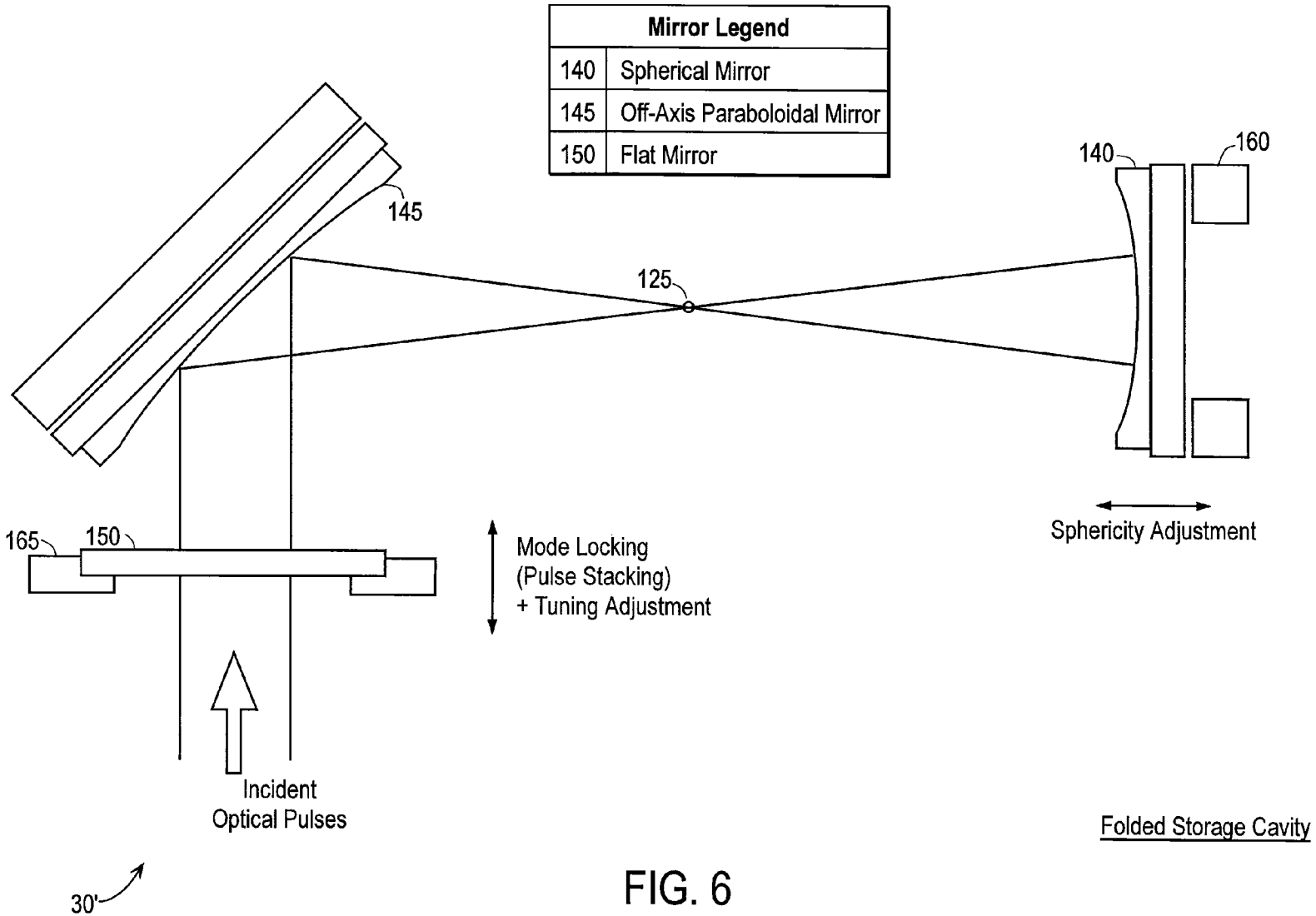
FIG. 6 is a schematic of a second configuration of an optical cavity suitable for practicing embodiments of the present invention.

FIG. 6 is a schematic of a second configuration designated 30', of optical cavity 30 suitable for practicing embodiments of the present invention. This configuration is capable of independently optimizing the focal spot (via cavity sphericity) and pulse stacking. This design uses three mirrors (two curved cavity mirrors 140 and 145, and a substantially flat mirror 150) to produce a linear cavity axis which is folded in the manner shown. The region of the cavity which encloses the tightly focused waist is delimited by curved mirrors 140 and 145.

Mirror 140 is a substantially spherical symmetric mirror defining one end-mirror of the cavity, and reflects the cavity beam at normal incidence. Mirror 145 is an intermediate off-axis paraboloidal mirror, and reflects the cavity beam at an appropriate oblique angle of incidence, such as 45°, to flat mirror 150, which defines the other end-mirror of the cavity. The basic radii of curvature of the mirrors are designed so that the stored beam between spherical end-mirror 140 and off-axis paraboloidal mirror 145 converges to a tight focus at the waist, designated 155, and the stored beam between the off-axis paraboloidal mirror and the flat end-mirror is substantially collimated with a waist at the position of the flat mirror (i.e., the wavefronts are substantially planar at the flat mirror).

Optimization of the focal spot (via cavity sphericity) is achieved by placing the spherical cavity end-mirror on a movable stage 160 so that its separation with respect to the intermediate paraboloidal mirror can be adjusted independently of the flat mirror. By allowing for such independent and possibly dynamic optimization of the cavity sphericity to achieve and maintain a tight focus, it is no longer required to apply an external thermal or mechanical distortion to maintain the curvature of these mirrors. Optimization of pulse stacking is achieved simultaneously by placing the flat cavity end-mirror on a movable stage 165 so that its separation with respect to the intermediate paraboloidal mirror can be adjusted independently of the spherical end-mirror; since the stored beam is substantially collimated with a large transverse radius in this region of the cavity, the pulse-stacking adjustment can be effected without substantially affecting the focused beam in the interaction region of the cavity.

It should be noted that, in principle, the problem of independent optimization of the cavity sphericity and pulse stacking does not arise if the repetition rate of the pump laser is continuously adjustable over a sufficiently wide range of repetition rates. In such a case the storage cavity could be constructed to provide a tightly focused beam at the waist, and the repetition rate of the pump laser could then be adjusted to satisfy the pulse stacking requirement. But there are some pump lasers, such as the RF linac free-electron laser, which do not have sufficient adjustability in the repetition rate even to account for manufacturing imperfections in the storage cavity, and the cavity construction would then have to incorporate all of the techniques to achieve this optimization simultaneously.

In certain embodiments in which certain system parameters are specified, such as, for example, the radiation interval duration, storage cavity length, and drive laser power, the mirror transmittances may be chosen to couple sufficient power from the drive laser into the cavity to maximize either the circulating optical micropulse power at the end of the radiation interval, or the integrated optical energy which passes through the interaction region of the storage cavity during the radiation interval. However, other values of the mirror reflectances may be required to achieve the desired vector potential in the interaction region of the storage cavity.

For example, if the drive laser power is so high that the vector potential exceeds the desired value when the reflectances are optimized for peak circulating power or integrated circulating energy, then the reflectances can be reduced as required to achieve the desired vector potential, which would also yield a more uniform time-dependence of the circulating optical power in the storage cavity during the radiation interval. In certain practical embodiments such as the ones considered here, the absorption losses of the mirrors are negligible, so that energy that is not reflected from the mirror may be considered to be transmitted through the mirror. Methods to account for non-zero absorption losses are known to practitioners in the art.

The choice of the distribution of reflectance losses among the optical elements which do not comprise the coupling element depends on the desired coupling efficiency, defined as the ratio of coupling losses to total losses. If the coupling efficiency is unity, then the greatest power buildup in the cavity will be obtained, but the resulting level of reflected power in this case may require isolation optics between the drive laser and storage cavity to reduce back-reflections into the drive laser. This reflected power can be minimized by designing a loss-matched cavity (for example, a two-mirror cavity whose mirror reflectances are equal), but this would reduce the power buildup in the cavity compared to the case of unity coupling efficiency. Other values of the coupling efficiency can be chosen to select an appropriate tradeoff between the reflected and transmitted power.

System Configuration Considerations

By positioning such an optical storage cavity in the vicinity of the e-beam focus so that the foci of the e-beam and stored optical pulses coincide, and controlling the timing of the injected optical pulse and/or accelerated e-beam to cause the two beams to cross at their shared foci, the electrons in each repetitive bunch of the accelerated beam will be subjected to the intense undulator field generated by the intense, stored optical pulse at or near the optical pulses' peak intensity, achieving the conditions required for efficient generation of undulator radiation on each collision, and high average X-ray fluence and brightness through the multiple, successive collisions of these smaller electron bunches with the high intensity optical pulses circulating in the optical storage cavity.

The focal parameters for the circulating optical pulse needed to optimize operation of the system differ somewhat than for the e-beam. While optimization of the horizontal and vertical spot sizes of the e-beam at the focus generally requires no more than minimizing the spot sizes consistent with the limits imposed on angular spread by the angular dependence of the wavelength of the back-scattered x-rays, the focal parameters for the stored optical pulse are preferably chosen to optimize the overlap of the optical pulse with the electron bunches.

In the simplest case—collinear propagation of the electron beam and optical pulse along the same axis, but in opposing directions—the power density of the optical field with which the electrons interact will vary with time and position depending both on the length of the optical pulse as determined by the design of the pump laser and the characteristic dependence of optical beam diameter and area near the focus determined by the laws of diffraction. The optical spot radius w(z) typically varies with axial position z relative to the position of the focal spot as:

$$w(z)=w_0[1+(z/z_R)^2]^{1/2}$$

where:

$w_0$ is the spot radius at the focus, and $z_R$, the Rayleigh parameter, specifies the "depth of field" of the focal spot.

It can be shown by considering the characteristic dependence on optical power density of the intensity of the undulator radiation emitted by the electrons that an electron traveling though a continuous focused optical beam would radiate half of the energy emitted in traveling from − to + infinity in a distance +/−zr from the focus. Accordingly, the pulse length of the circulating optical micropulse can be reduced to the order of twice the Rayleigh parameter $z_R$ with the loss of no more than a factor of two in the number of backscattered x-ray photons as compared to the case in which the electrons collided with a continuous optical beam of the same peak intensity provided that 7) the cross-section of the optical pulse in the focal region remains matched to the cross-section of the electron beam,
8) the electrons encounter the counter propagating optical pulse at some time during the interval between the time the centroid of the optical pulse reaches the point one Rayleigh parameter before the focus, and the time the centroid of the pulses reaches the focus,
9) the optical pulse has a duration generally equal to or less than twice the Rayleigh parameter divided by the speed of light, and
10) the Rayleigh parameter for the optical storage cavity has been set approximately equal to or greater than the length of the electron bunches provided by the accelerator driver.

If these conditions are satisfied, the electrons moving through the optical pulses circulating in the storage cavity will encounter the optical field in the region of space around the focal point at which the optical power density is within a factor of two of the intensity at the focus, and generate an x-ray beam of fluence and brightness within a factor of two of the x-ray beam generated by the same electrons moving through a continuous optical beam with a power equal to the peak power of the of the circulating pulse in the optical storage cavity.

Cavity Dimensions and Mirror Reflectance Analysis

A representative design hierarchy for the laser-driven storage cavity, which yields the desired vector potential in the interaction region while limiting the optical intensity or thermal power loading at the mirrors to below the applicable damage thresholds, is described below. This design procedure is intended to be exemplary, not exclusive or limiting.

The representative design starts with the pump laser wavelength $\lambda$, laser micropulse duration $\tau_p$ and peak power $P_{inc}$, and micropulse repetition rate $\nu_p$, which are all typically determined by the available laser system. The desired intracavity $1/e^2$-intensity beam radius $\omega_0$ of the $TEM_{00}$ mode in the interaction region of the cavity may then be specified, depending, for example on the emittance characteristics and focusing geometry of the electron beam to which the optical beam is matched.

The desired normalized vector potential $a_n$ on-axis in the interaction region is then specified as required for the application in question. The rms vector potential $a_n$ is related to the rms optical electric field $\hat{E}$ in cgs units by the expression $$a_n = \frac{e\hat{E}\lambda}{2\pi mc^2}$$

where e and m are the electron charge and mass, $\lambda$ is the optical wavelength, and c is the speed of light. Upon determining the on-axis electric field $\hat{E}$ from $a_n$, the on-axis optical intensity $I_P$ in cgs units can then be calculated from the expression $$I_p = \frac{c}{4\pi}|\hat{E}|^2$$

The conversion to mks units of intensity is well known, and the corresponding circulating micropulse peak power $P_{circ}$ is obtained from the on-axis intensity by the relation $$P_{circ} = I_p\left(\frac{\pi\omega_0^2}{2}\right)$$

For injected micropulses of peak power $P_{inc}$ which are perfectly phased with respect to the cavity length and so coherently reinforce the circulating optical micropulses, the circulating power $P_{circ}$ during pass n in the cavity (starting from an empty cavity on pass 0) is described by the following equation:

$$\frac{P_{circ}}{P_{inc}} = \frac{t_i^2}{\left(\frac{1}{4}\delta_c^2\right)}[1 - 2e^{-\delta_c n/2} + e^{-\delta_c n}]$$

where $t_i^2$ is the fractional power coupling coefficient at the input mirror and $\delta_c$ is the fractional round-trip cavity power loss. The integrated optical energy $K_{cav}$, defined as the total optical energy incident on each of the cavity mirrors during the radiation interval, is derived by integration of the above expression to be $$K_{cav} = \overline{P_{inc}}T_\Omega\frac{t_i^2}{\left(\frac{1}{4}\delta_c^2\right)}\left[1 - \frac{4}{\delta_c N}(1 - e^{-\delta_c N/2}) + \frac{1}{\delta_c N}(1 - e^{-\delta_c N})\right]$$

where $\overline{P_{inc}}$ is the time-averaged incident laser power during the radiation interval, $T_\Omega$ is the duration of the radiation interval, and N is the total number of cavity round-trips during the radiation interval.

For a radiation interval with a total of N round-trips in the cavity, the circulating peak power $P_{circ}$ at the end of the radiation interval (i.e. at pass N) is maximized for a cavity loss $\delta_c$ satisfying $\delta_c N=2.52$, and the integrated optical energy $K_{cav}$ is maximized for $\delta_c N=3.78$. A useful design compromise between these two cases is obtained using the criterion $$\delta_c N=3.056 \quad \text{(Eq. 1)}$$

for which $P_{circ}=(0.985)P_{circ}^{max}$ and $K_{cav}=(0.985)K_{cav}^{max}$ and the circulating peak power $P_{circ}$ at the end of the radiation interval is then given (for cavity designs in which $t_i^2$ dominates the cavity loss $\delta_c$) by $$\frac{P_{circ}}{P_{inc}} = \frac{2.45}{\delta_c} \quad \text{(Eq. 2)}$$

The fluence $F_\Omega$ (i.e., the integrated energy per unit area on-axis) during the radiation interval at the cavity mirrors in a symmetric cavity of length $L_c$ is then obtained from the $TEM_{00}$ mode geometry as $$F_\Omega = \frac{8\pi\omega_0^2}{\lambda^2}\left(\frac{\tau_p\nu_p}{c}\right)P_{circ}\frac{0.94N}{L_c} \quad \text{(Eq. 3)}$$

and the duration $T_\Omega$ of the radiation interval is related to the cavity length $L_c$ by $$T_\Omega = \frac{2L_c}{c}N$$

Equations 2, 1, and 3 form the basis for a point-design procedure to limit thermal power loading which can be modified as desired to accommodate other system parameters or requirements. For example, the following design for a free-electron-laser-based system emerges directly from the above procedure:

$\lambda$=1 μm
$\omega_0$=10 μm [for which $z_R$=0.31 mm=c(1 ps)]
$\tau_p$=1 ps
$\nu_p$=2.86 GHz
$P_{circ}$=43 GW [corresponding to $a_n$=0.1]
$P_{inc}$=50 MW [corresponding to an inverse-tapered FEL]
$F_\Omega$=60 J/cm$^2$ [a conservative fluence damage threshold for $T_\Omega$=1 μs]

For the above parameters, Eq. 2 specifies a round-trip cavity loss of $\delta_c$=0.285%, Eq. 1 then specifies a total of N=1073 round trips in the cavity, and Eq. 3 and its successor together then specify a duration (assuming that the damage threshold scales in proportion to the square root of $T_\Omega$) of $T_\Omega$=5.4 μs for the radiation interval.

The cavity dimensions can then be calculated for the specific cavity parameters obtained by the above design procedure. In the present example, the corresponding cavity length is $L_c$=0.75 m, which can then be increased as required to match the nearest integral number of circulating micropulses in the cavity; in this example $L_c$=0.786 m. The $1/e^2$-intensity radius $\omega_{mirr}$ of the $TEM_{00}$ mode at the mirrors for this cavity length is then $\omega_{mirr}$=12.5 mm, and the diameter $\phi_{mirr}$ of the cavity mirrors may be chosen conservatively to be $\phi_{mirr}$=60 mm.

For operating regimes in which the damage mechanisms occur on fast time scales dependent on the peak optical intensity (as opposed to the integrated optical fluence), the chosen design must be compatible with the applicable damage thresholds for the processes in question. The peak circulating micropulse intensity (i.e., the peak micropulse power per unit area on-axis) at the end of radiation interval at the cavity mirrors in a symmetric cavity of length $L_c$ is $$I_{mirr} = \frac{P_{circ}}{\left(\frac{\pi\omega_{mirr}^2}{2}\right)} = \frac{8\pi\omega_0^2}{\lambda^2 L_c^2} P_{circ}.$$

Thus, for a prescribed beam radius $\omega_0$ and circulating peak micropulse power $P_{circ}$ chosen to yield the desired vector potential $a_n$ in the interaction region, the length $L_c$ of the symmetric optical storage cavity is determined independently of fluence considerations. For the final system design, the system parameters must be compatible with the damage thresholds for both the optical intensity-dependent, and the integrated fluence-dependent, damage mechanisms.

Control and Stabilization of Synchronization

As described above, it is important that the electron micropulses, the optical micropulses from the pump laser, and the circulating optical micropulses in the storage cavity be synchronized. There are a number of possible approaches to accomplishing this. In summary, embodiments of the present invention may provide sensors and controls for setting and stabilizing one or more of the following:

- the focal parameters and round-trip transit time of the optical cavity;
- the lasing and optical micropulse periodicities of the pump laser(s);
- the frequency of the e-beam accelerator(s); and
- the phase and e-beam steering of the accelerator(s).

Preferred embodiments seek to stabilize at least some, and preferably all of the above.

Figure 7A:
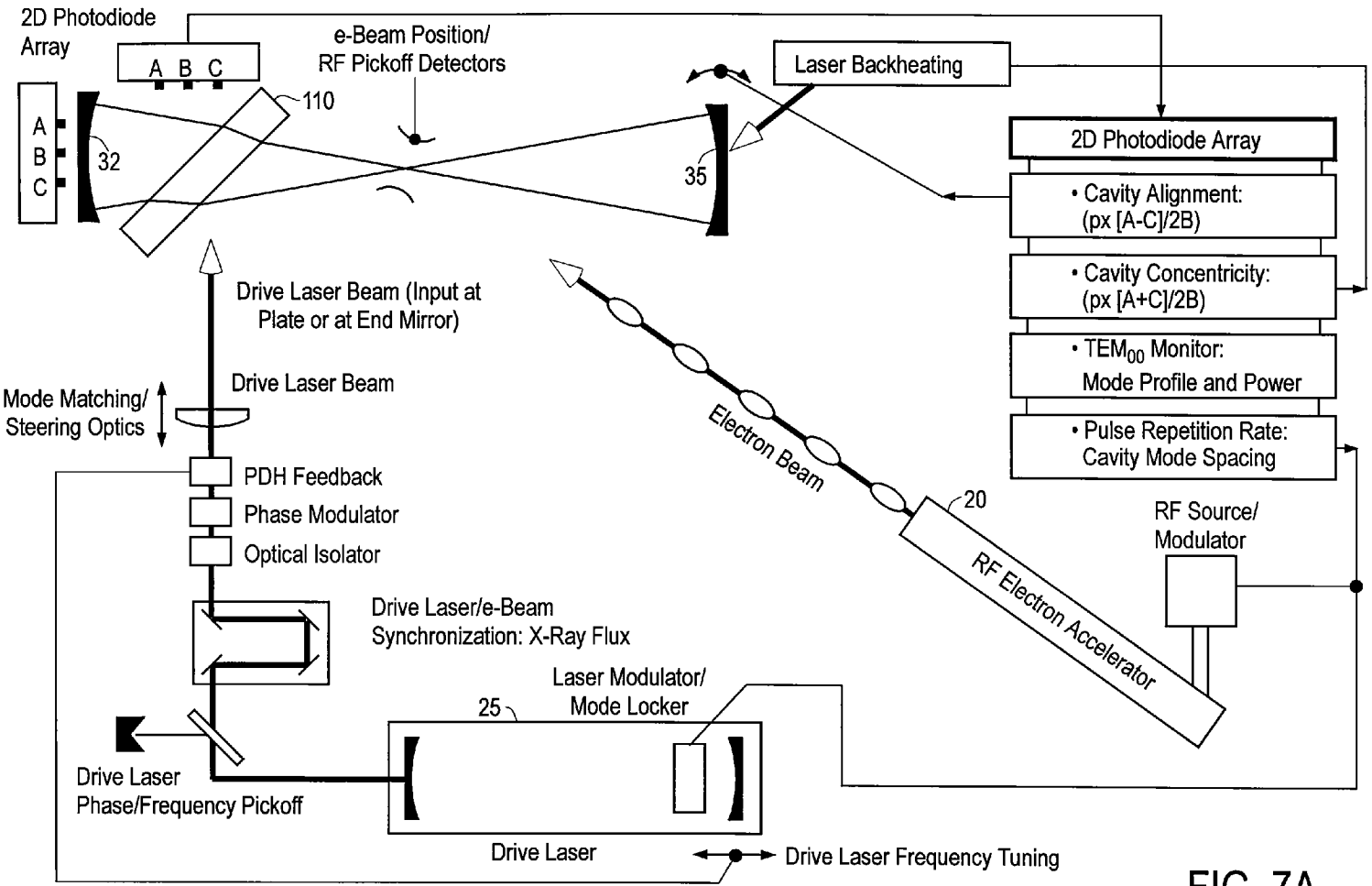
FIGS. 7A and 7B are schematics for embodiments using the first and second cavity configurations, respectively, showing representative control elements for maintaining desired timing relationships between the incident optical micropulses, the circulating optical micropulses, and the incident electron micropulses.
Figure 7B:
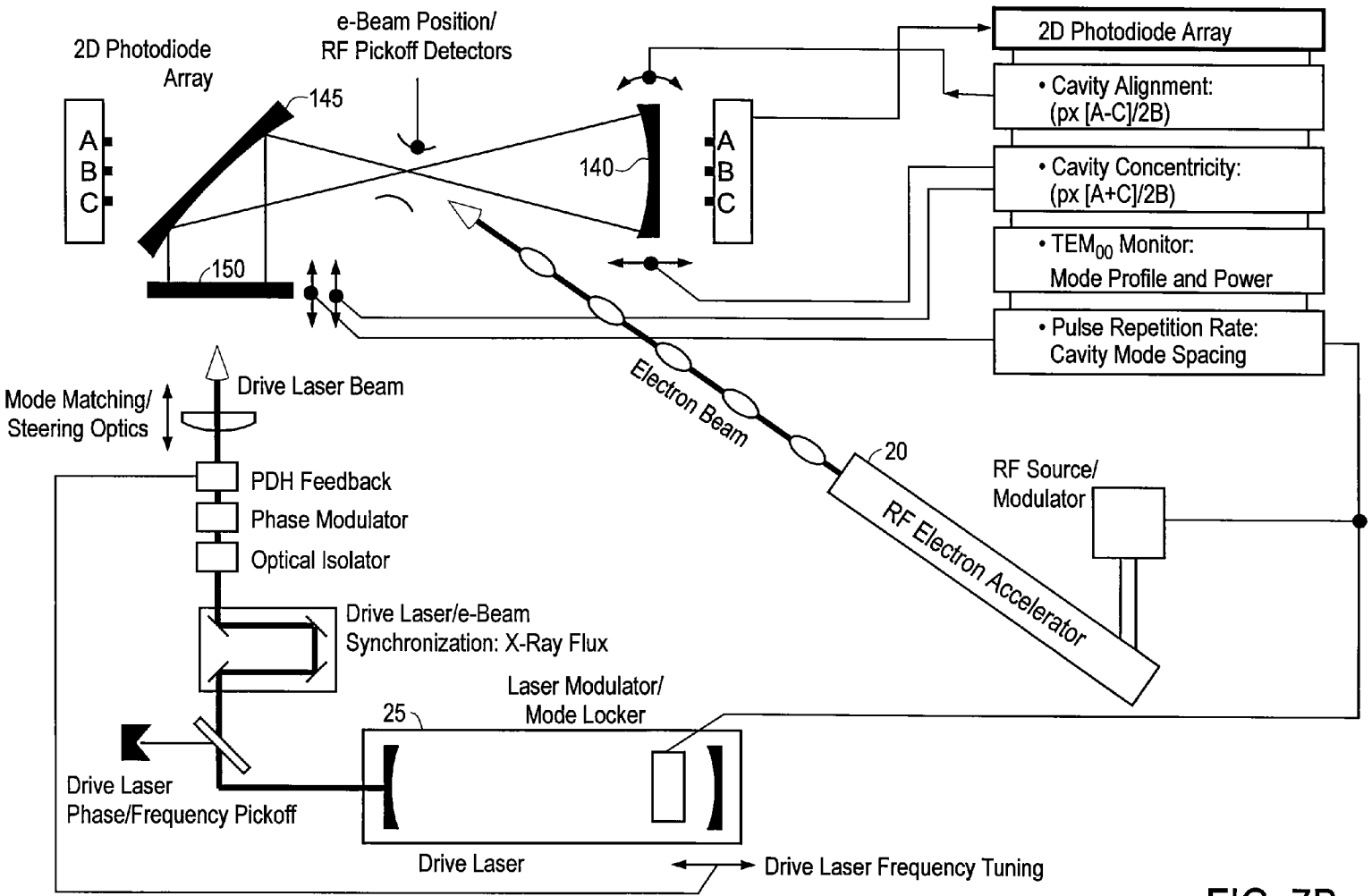

FIGS. 7A and 7B are schematics showing representative control elements for effecting control and stabilization of synchronization. FIG. 7A corresponds to an embodiment using the first (Brewster-compensated) cavity configuration shown in FIG. 5; FIG. 7B corresponds to an embodiment using the second (folded) cavity configuration shown in FIG. 6. The diagnostics and controls are designed to accommodate the transient, as well as the steady-state, operational regime of the storage cavity, some embodiments of which may be constrained by the finite duration of the radiation intervals to provide the maximum stored circulating optical power and integrated optical energy. Such optimum cavities typically do not achieve steady-state operation, and so must include diagnostics and controls which monitor both the frequency and phase of the periodic drive laser and electron beam inputs, and of the circulating optical pulses.

The primary diagnostics for the circulating optical pulses in the optical cavity include one or more 2-D and/or 3-D photodiode arrays and fast photodiodes capable of recording the spatial and temporal evolution of the intracavity pulses as they build up on repeated round trips. These detectors are configured at one or more of the cavity ports to measure the shape and position of the transverse mode profile, and the temporal dependence of the circulating optical intensity on a time scale faster than the cavity round-trip transit time.

The primary diagnostics for the incident electron bunches include one or more beam position monitors and RF pickoff detectors near the interaction region, and x-ray detectors to measure the generated high energy photon power and/or flux. Diagnostics are also included for the frequency and phase of the incident laser pulses from the drive laser system.

Controls are preferably provided for at least one, and more preferably for several or all of the following:

- the concentricity of the optical storage cavity mirrors. Representative controls may consist of translation and/or laser backheating of the optical storage cavity mirrors.
- the round-trip transit time of the circulating optical pulses. Representative controls may consist of mirror translation on the scale and sensitivity of the optical pulse envelope.
- the frequency matching of the drive laser to the optical storage cavity. Representative controls may provide laser cavity mirror translation on the scale and spatial resolution of a fraction of the optical wavelength.
- the micropulse repetition frequency of the drive laser system.
- the microbunch repetition frequency of the RF electron accelerator.
- the transverse alignment of the optical storage cavity mirrors.
- the transverse alignment and timing of the drive laser beam.
- the longitudinal alignment and mode matching of the drive laser beam.
- the transverse alignment and timing of the incident electron bunches.
- the synchronization of the optical pulses from the drive laser with the incident electron bunches.

Drive Laser Cavity-coupling Coefficients

The required sensitivities of the controls which maintain optimum alignment of the drive laser and storage cavity depend upon the system parameters that determine the overlap of the drive laser spatial mode with the $TEM_{00}$ mode of the storage cavity. If the drive laser mode is itself a $TEM_{00}$ mode, then its coupling to the cavity mode is determined analytically by the following power coupling coefficients η calculated from Gaussian mode theory (here, we assume that perfect spatial alignment of the drive laser and cavity modes corresponds to a power coupling coefficient of unity):

1) If the incident drive laser beam is perfectly aligned and mode matched to the cavity mode except for a uniform transverse displacement δ from the cavity axis, then $$\eta = \exp\left[-\left(\frac{\delta}{\omega_0}\right)^2\right],$$

where $\omega_0$ is the $1/e^2$-intensity beam radius of the $TEM_{00}$ mode at the waist.

2) If the incident drive laser beam is perfectly aligned and mode matched to the cavity mode except for an angular displacement of $\vartheta$ from the cavity axis at the waist, then $$\eta = \exp\left[-\left(\frac{\vartheta}{\vartheta_0}\right)^2\right],$$

where $\vartheta_0$ is the $1/e^2$-intensity half-divergence angle of the $TEM_{00}$ mode in the far field.

3) If the incident drive laser beam is perfectly aligned and mode matched to the cavity mode except for a longitudinal displacement of $\Delta z$ along the cavity axis, then $$\eta = \frac{1}{1+\left(\frac{\zeta}{2}\right)^2},$$

where $\zeta \equiv \Delta z/z_R$, and $z_R$ is the Rayleigh range of the cavity mode.

4) If the incident drive laser beam is perfectly aligned and mode matched to the cavity mode except for a mismatch in the beam radius at the waist, then $$\eta = \frac{4}{\left(\frac{\omega_b}{\omega_0}+\frac{\omega_0}{\omega_b}\right)^2},$$

where $\omega_b$ is the $1/e^2$-intensity beam radius of the drive laser mode at the waist.

Any incident drive laser power which is not coupled to the $TEM_{00}$ cavity mode or absorbed by the optical elements is reflected from the cavity.

Independent (i.e., master) and dependent (i.e., slave) controls are coupled in a representative embodiment as follows (actual embodiments may include any subset of the following):

1. Alignment and Focusing of the Optical Cavity:

Alignment and focusing of the optical cavity may be accomplished by one or more of the following:

- the concentricity of the optical storage cavity mirrors is controlled independently by feedback from the photodiode arrays monitoring the transverse shape and width of the transmitted $TEM_{00}$ mode profile;
- the transverse alignment of the optical storage cavity mirrors is controlled independently by feedback from the photodiode arrays monitoring the transverse position of the transmitted $TEM_{00}$ mode.
- the timing and/or phase of the circulating optical pulses in the storage cavity are monitored independently by a phase signal derived from the photodiode arrays monitoring the circulating power of the intracavity $TEM_{00}$ mode, and provides an adjustable phase offset for the incident drive laser pulses in order to maximize the circulating power of the intracavity $TEM_{00}$ mode.

2. Alignment and Timing of the Incident Drive Laser:

Alignment and timing of the incident drive laser may be accomplished by one or more of the following:

- the transverse alignment of the incident drive laser beam is controlled independently by feedback from the photodiode arrays monitoring the power of the $TEM_{00}$ mode;
- the longitudinal alignment and spatial mode matching (Siegman 1986b) of the incident drive laser beam are adjusted independently for optimum coupling to the intracavity $TEM_{00}$ mode, and may be controlled independently by feedback from the photodiode arrays using mode profile information recorded at two or more of the ports of the storage cavity;
- the frequency matching (or crest-to-crest wavefront matching) of the incident drive laser pulses to the circulating pulses in the optical storage cavity is controlled independently by the Pound-Drever-Hall (PDH) laser stabilization technique (Drever 1983), where the PDH error signal is used to adjust the frequency (via mirror translation) of either the optical storage cavity or of the drive laser system;
- the timing and/or phase of the incident drive laser beam is monitored independently by a pickoff signal derived from the incident drive laser beam and directed into an independent photodiode detector;
- these controls may be duplicated as necessary for any multiplicity of drive lasers forming the drive laser system.

3. Alignment and Timing of the Incident Electron Beam:

Alignment and timing of the incident electron beam may be accomplished by one or more of the following:

- the transverse alignment of the incident electron bunches is independently controlled by feedback from the proximity beam position monitors near the interaction region and optimized to maximize the intensity of the generated x-rays;
- the timing and/or phase of the incident electron bunches is coupled to and controlled by the phase signal derived from the RF pickoff detectors near the interaction region, including an adjustable phase offset to optimize the synchronization of the incident electron bunches with the optical pulses from the drive laser, and to maximize the generated high energy photon power and/or flux;
- these controls may be duplicated as necessary for any multiplicity of electron accelerators forming the source of electron bunches.

4. Micropulse Repetition Frequency of the Drive Laser System and e-beam Accelerator:

Micropulse repetition frequency of the drive laser system and e-beam accelerator may be controlled by one or more of the following:

- the round-trip frequency of the circulating optical pulses in the storage cavity, and the micropulse repetition frequencies of the drive laser system and the RF electron accelerator, are mutually coupled as a single master with two slaves.
- in a representative embodiment, the micropulse repetition frequencies of the drive laser system and the RF electron accelerator are coupled to and controlled by the round-trip frequency of the circulating optical pulses in the storage cavity, derived from the photodiode arrays and/or fast photodiodes monitoring the circulating power of the $TEM_{00}$ mode.
- in an alternative embodiment, the micropulse repetition frequency of the drive laser system, and the round-trip frequency of the circulating optical pulses as controlled by the translation of the storage cavity mirrors, are coupled to and controlled by the microbunch repetition frequency of RF electron accelerator;

these controls may be duplicated as necessary for any multiplicity of drive lasers and electron accelerators.

Control System using Auxiliary Low-Power Cavities

Figure 8:
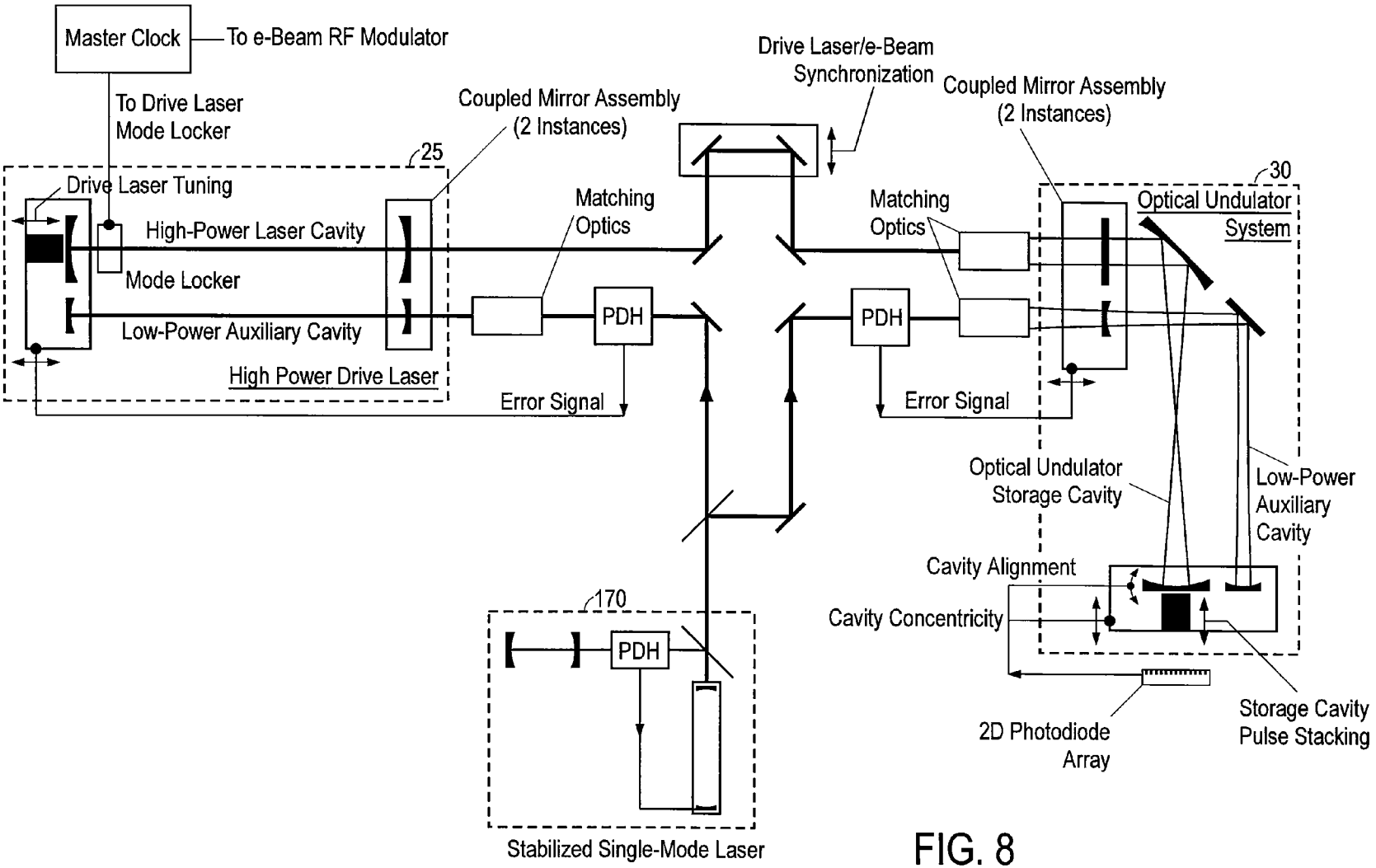
FIG. 8 is a schematic of an embodiment of a control system using auxiliary optical cavities.

FIG. 8 is a schematic of an alternative control system for matching the frequencies of the drive laser and the storage cavity. The primary difference between FIG. 8 and the control system shown in FIGS. 7A and 7B is the introduction of a mechanically coupled, low power auxiliary cavity for each of the high power drive laser and the optical undulator storage cavity (either the Brewster-coupled or folded design). The main feature of these auxiliary cavities is that their mirrors are mechanically or otherwise rigidly mounted on a common base with respect to the mirrors of the high power cavities, so that each pair of coupled mirrors can be made to translate in unison with each other; these pairs of coupled mirrors are labeled "coupled mirror assembly" in the figure. Note that the auxiliary cavity mirrors for the folded storage cavity are schematically shown as displaced to the side, but in a preferred embodiment using the folded cavity the auxiliary mirrors would be placed "above" their respective mirrors, i.e., outside of the plane of the folded cavity.

The purpose for introducing the auxiliary cavities is that instead of directly stabilizing the high power drive laser to the storage cavity using the Pound-Drever-Hall or other technique, these auxiliary cavities can be stabilized and frequency-locked directly to a separate, low-power frequency-stabilized laser 170; the stable mechanical coupling which is built into the coupled mirror assemblies can then be used to transfer this stability to the high power laser and storage cavities indirectly. The single-mode cw laser used to stabilize the auxiliary cavities can be of a different wavelength than the pulsed beam delivered by the drive laser.

This alternate technique has two main advantages for optical undulators which employ a finite radiation interval. First, by applying the laser stabilization technique (e.g., Pound-Drever-Hall, "PDH") to the low-power auxiliary cavities instead of to the high power drive laser, the optical conditioning on the high power drive laser beam (e.g., phase modulation and polarization control) is avoided, and the matching of the drive laser beam into the high power storage cavity can be more easily and reliably implemented. Second, since the auxiliary cavities remain locked to the stable, cw laser continuously and thus transfer their stability to the high power cavities continuously, the high power cavities remain "frequency-locked" to each other even during those times between the radiation intervals when the high power drive beam is absent.

For the configuration shown in FIG. 9, a representative control hierarchy for operation is as follows:

1) The master clock provides the timing signal for the drive laser mode locker and the electron beam.
2) The auxiliary cavities are frequency locked to the stabilized single-mode laser using separate Pound-Drever-Hall ("PDH") systems, with the error signals fed back to the respective coupled mirror assemblies as illustrated.
3) The operation of the high power drive laser is optimized by adjusting the drive laser tuning actuator independently of the low power auxiliary cavity.
4) The operation of the optical undulator storage cavity is optimized for operation on the $TEM_{00}$ mode by matching the drive laser beam into the storage cavity and adjusting the storage cavity pulse stacking actuator independently of the low power auxiliary cavity.
5) The 2D-photodiode array is used to derive an error signal for the storage cavity mirror steering so that the spherical mirror remains aligned to the optical axis; in properly designed systems, the steering of the spherical mirror can be adjusted independently of the frequency matching and pulse stacking.
6) The 2D-photodiode array is also used to derive an error signal for the storage cavity concentricity so that the $TEM_{00}$ mode size remains stable; in general, this compensation introduces changes in the overall cavity length that would affect the frequency matching. However, since the optical undulator storage cavity is mechanically coupled to the low power auxiliary cavity, the PDH feedback system immediately and continuously compensates any change in the cavity length (deliberate or otherwise); the overall cavity length remains stable, and the frequency locking of the storage cavity to the drive laser is preserved.
7) Under stable operation of the storage cavity on the $TEM_{00}$ mode, the storage cavity pulse stacking actuator can be dithered slightly to produce an error signal that can in turn be used to keep that actuator adjusted for maximum $TEM_{00}$ mode power.
8) When stable operation of the $TEM_{00}$ mode has been achieved, the drive laser/e-beam synchronization stage can be slowly scanned to optimize overlap of the stored optical pulses with the electron bunches and so maximize x-ray production.

Turn-on Procedure for Establishing and Controlling a Stable, Stored Optical Beam The following procedure is a representative procedure for initially turning on the system for high power operation and production of x-rays. It is not meant to be exclusive.

1) Initial Cavity Preparation:

The initial alignment of the cavity is achieved 'manually' with the controls deactivated. The cavity round trip time, to which the micropulse repetition frequencies of the drive laser and electron accelerator must be matched during operation, can be established either by careful measurement of the physical distances involved, or by injection of a single seed micropulse whose unperturbed circulation in the cavity can be measured using the photodiode diagnostics. The initial transverse alignment of the cavity, including the alignment and matching of the input laser, can be achieved by injection of a low power drive laser beam such that the waist of the transformed, injected beam is spatially aligned with the waist of the cavity, and the transverse alignment of the mirrors can then be adjusted by observing the symmetry and position of the low power and incoherent intracavity beam on the photodiode arrays. This alignment of the drive laser and cavity mirrors can be iterated as necessary. By these and similar procedures, the cavity can be prepared in a state of substantial alignment, except for remaining minor adjustment during operation, to allow some initial coherent build up of the injected laser.

2) Initial Establishment of a Low-Power, Stable Stored Beam:

The initial establishment of a coherent, circulating optical beam is best accomplished with the controls deactivated, and at sufficiently low drive laser power so that thermal distortions are not imposed on the cavity optics when the cavity adjustments yield a sudden onset of coherent pulse stacking and a corresponding increase of the intracavity power. At these low beam powers, the drive laser is injected into the cavity, and the micropulse repetition frequency of the drive laser system is adjusted to match the round trip frequency of the storage cavity (for cavity configurations in which the round trip frequency can be adjusted independently of the concentricity, the round trip frequency of the storage cavity can be adjusted to match the micropulse repetition frequency of the drive laser system.) If the adjustments are sufficiently slow, the injected drive laser will be observed to excite resonances in the cavity, perhaps only sporadically at first, and the magnitude of the fluctuations will indicate the degree of coupling (i.e., mode locking) of the drive laser to the intra-cavity beam.

At this point, the optical frequency of the drive laser (or the cavity mirror translation on the scale of a fraction of an optical wavelength) is carefully adjusted to excite a resonance of the storage cavity. This resonance will appear on the photodiode diagnostics as a quasi-stable mode profile sensitive to the optical frequency adjustments. The resulting resonance will not necessarily represent excitation of the $TEM_{00}$ mode, but rather one of the other higher order transverse modes, and thus the frequency adjustment should be continued until a $TEM_{00}$ resonance is observed to build up in the cavity. Using this established $TEM_{00}$ resonance as a reference, the transverse cavity alignment and cavity concentricity should be carefully adjusted, iteratively with the frequency if necessary, to maximize the stored power in the $TEM_{00}$ mode.

3) Turn-On of the Control System:

At the low drive laser powers in Step 2, the controls for the cavity should then be activated, one control at a time. A representative order for activation is as follows: (a) transverse alignment of the cavity mirrors to center the stored beam on the photodiode arrays, (b) transverse and longitudinal alignment of the drive laser beam to maximize the coupling to the stored $TEM_{00}$ mode, (c) activation of the Pound-Drever-Hall (PDH) laser stabilization system to lock the drive laser optical frequency to the axial modes of the resonant $TEM_{00}$ mode, (d) concentricity of the storage cavity to achieve the desired focal parameters and beam size in the interaction region (the corresponding change in the cavity length will be compensated and tracked at this point by the PDH stabilization system), and (e) locking of the micropulse repetition frequency to the round-trip frequency of the storage cavity.

4) Final Establishment of a High-Power, Stable Stored Beam:

After turning on the controls in Step 3, the drive laser power can be slowly increased to achieve the desired normalized vector potential in the interaction region of the cavity. Ideally, this would proceed without perturbation of the intracavity beam or optics. However, if distortion of the mirrors or optics is induced at the higher powers, the primary effect on the cavity will be a distortion of the cavity concentricity and a resulting change in the size of the $TEM_{00}$ mode. With the control system fully activated, these changes should be compensated even at high powers. However, if the compensation does not result in an optimum final system configuration (for example, if one of the control parameters ends up outside of its optimum range), then the alignment and turn-on procedure can be repeated at low power to re-initialize the starting configuration, so as to yield a high-power configuration which is then optimized.

5) Generation of X-Rays:

After establishing the optical undulator in Steps 1 through 4, the electron beam can then be focused into the interaction region, with the accelerator micropulse repetition frequency locked to the drive laser and storage cavity frequencies, and the relative phase can then be adjusted to collide the electron bunches with the stored optical pulses in the interaction region. The primary diagnostic for this procedure will be the generation of high-energy photons on the x-ray detector. The transverse and longitudinal alignment and timing of the electron beam can then be adjusted to optimize the generated x-ray power.

Multiple Undulator Embodiments

While the above discussion considered an electron beam being subjected to the intense undulator field in a single cavity, it is possible to share an electron beam among multiple optical cavities, and therefore provide multiple x-ray sources. This is possible because even at normalized vector potentials approaching unity the probability for x-ray emission remains small, so that even after passing through a half-dozen such interaction regions most of the electrons in the beam will have their full unperturbed momenta and energy. The ability to share an electron beam among multiple x-ray sources is significant for at least the reason that the electron beam facility is expensive. This is a valuable feature for labs that use such x-rays for protein crystallography and other applications that can benefit from multiple x-ray sources.

Figure 9A:
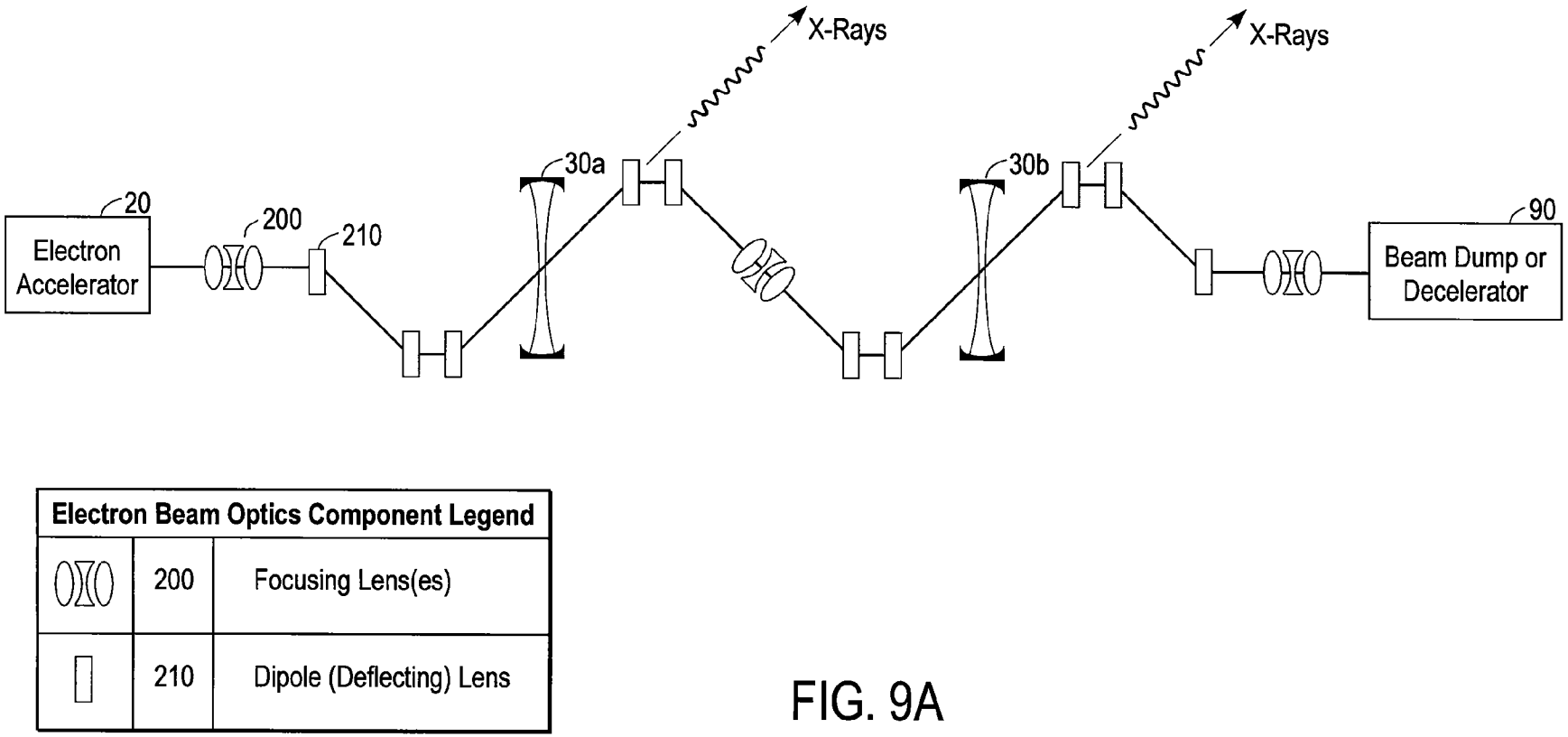
FIGS. 9A and 9B are schematics of alternative approaches to sharing a single electron beam among multiple optical undulators.
Figure 9B:
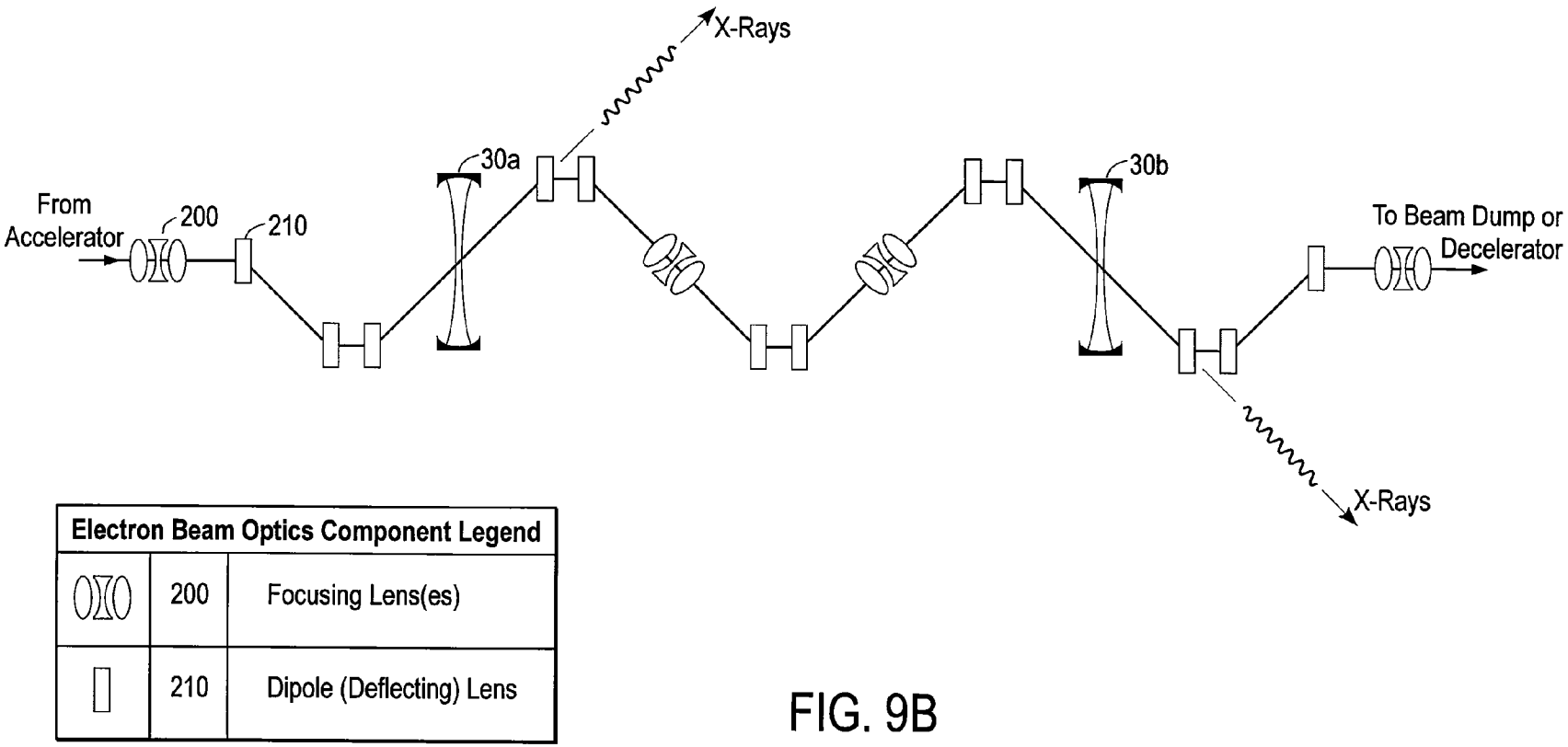

FIGS. 9A and 9B are schematics of alternative approaches to sharing a single electron beam among multiple optical undulators. In both embodiments, the electron beam is focused using well-known elements such as quadrupole magnets 200, and is then deflected using well-known elements such as dipole magnets 210. After passing through a first optical cavity 30*a*, the beam is then deflected and focused to pass through a downstream optical cavity 30*b*. While the figures show only two such cavities, it is possible to provide additional cavities.

FIG. 9A shows a configuration where the x-ray beams are all directed to one side of the original electron beam direction. Note that by using this configuration, it is possible to refocus the electron beam at multiple interaction regions in optical cavities downstream from the first interaction region in the first optical storage cavity to drive a multiplicity of independent x-ray beams. The configuration does not need a storage ring, but rather only an electron-beam transport channel (lattice) that can simultaneously direct the e-beam around a 5-30 degree arc, and refocus the electron beam at the interaction of the second storage cavity, and repeat the process for as many times as required to drive the number of beam lines to be used in the facility. This arrangement is suitable, whether or not the spent electron beam is decelerated before disposal as in an "energy recovery" linac, or simply disposed of in an appropriately designed high energy beam dump.

The comment about not needing a storage ring to serve multiple x-ray beam lines should not be interpreted to imply that the invention could not be used in connection with an electron storage ring.

FIG. 9B shows a configuration where the x-ray beams are directed to alternate sides of the original electron beam direction. The only change with respect to the configuration shown in FIG. 9A is the addition of another lens (e.g., quadrupole 200) and another pair of deflecting elements (e.g., dipoles 210) to the system for each additional optical cavity.

As noted above, the effective operation of UV, x-ray and gamma ray sources constructed according to the principles of the present invention require an electron-beam transport system that minimizes the effects of electron-beam energy spread and emittance in the transverse dimensions of the electron-beam in the interaction region. The electron-beam transport system should thus be designed to provide substantially zero dispersion in the interaction region, to permit the installation of focusing lenses to bring the electron-beam to a sharp focus in both the vertical and horizontal planes without altering the dispersion, and to refocus the beam following use in the interaction region for deceleration and disposal or use in a second interaction region for generation of a second independently tunable UV, x-ray, or gamma ray beam line.

The simple electron-beam transport systems shown in FIGS. 9A and 9B are examples of systems that can, by virtue of their symmetry, satisfy these requirements, while providing, in addition, the ability to spatially separate the UV, x-ray, and gamma ray beams generated in the successive interaction regions along the beamline to facilitate their simultaneous use in support of unrelated scientific, medical or industrial applications. This configuration also allows all of the focusing lenses to be placed at or near the locations of zero dispersion, eliminating (or minimizing) the effects of the lenses on the electron beam's downstream dispersion There are some further enhancements that can be added to these relatively simple designs. For example, sextupole magnets between the off-axis dipoles can be used to reduce or eliminate the achromatic aberrations attributable to the energy-dependent focusing terms introduced by the quadrupoles. This is because the focusing provided by the sextupoles is asymmetric as a function of transverse position, so off-axis high-energy electrons would see a stronger focusing effect than the off-axis low-energy electrons.

Design Priorities

In systems incorporating this invention, both the peak and average power densities incident on the optical surfaces of the cavity can be reduced by increasing the length of the cavity, the transverse radius of the cavity mirrors, and optical spot size at the mirrors and that such longer and larger cavities would be useful in the operation of systems using continuous or near-continuous e-beam sources like storage rings or superconducting linear accelerators.

By maximizing the number of x-rays produced by each electron used in the system consistent with the physics of the emission process and the properties of the available optical materials, the invention reduces the electrical power required for generation of the electron beam needed for operation, and also the ionizing radiation produced by the e-beam, to the lowest attainable level thereby reducing facilities and operating costs to a minimum while maximizing the intensity and brightness of the x-rays generated by the source.

REFERENCES

The following references are hereby incorporated by reference:

| | |
|---|---|
| Motz 1951 | Application of the Radiation From Fast Electron Beams, H. Motz, Journal of Applied Physics 22 (1951) pages 527-535 |
| Madey 1971 | Stimulated Emission of Bremmstrahlung in a Periodic Magnetic Field, J. J. J. Madey, Journal of Applied Physics 42 (1871) 1906 |
| Decker 1996 | Synchrotron Radiation Facilities in the USA, Glenn Decker, 5th European Particle Accelerator Conference (1996) 90 |
| Robinson 1991 | The ALS - A high Brightness XUV Synchrotron Radiation Source, A. L. Robinson and A. S. Schlachter, Proceedings of the 1991 Particle Accelerator Conference |
| Hettel 2002 | Design of the Spear 3 Light Source, R. Hettel et al, Proceedings of the 8th European Particle Accelerator Conference 2002 Paris, France |
| Galayda 1995 | The Advanced Photon Source, John N. Galayda, Proceedings of the 1995 Particle Accelerator Conference 1 (1995) pages 4-8 |
| Ruth 1998 | Compton Backscattered X-Ray Source, R. D. Ruth and Z. Huang, U.S. Pat. No. 5,825,847 (1998) |
| Ruth 2000 | Compton Backscattered Collimated X-Ray Source, R. D. Ruth and Z. Huang, U.S. Pat. No. 6,035,015 (2000) |
| Hartemann 2004 | Femtosecond Laser Electron X-Ray Source, F. V. Hartemann, H. A. Baldis, C. P. J. Barty, D. J. Gibson and B. Rupp, U.S. Pat. No. 6,724,782 (2004) |
| Elias 1979 | High-Power, CW, Efficient, Tunable (UV through IR) Free-Electron Laser Using Low-Energy Electron Beams, L. R. Elias, Phys. Rev. Letters 42 (1979) 977 |
| Heitler 1960 | Quantum Theory of Radiation, 3rd Edition (Oxford University Press 1960), W. Heitler, pages 211-224 |
| Lau 2003 | Nonlinear Thomson Scattering: A Tutorial, Y. Y. Lau, F. He, D. P. Umstadter and R. Kowalcyzk, Physics of Plasmas 10 (2003) pages 2155-2162 |
| Elleaume 2003 | Lecture on Insertion Devices, P. Elleaume, CERN Accelerator School (Brunnen, 2-9 July 2003) |
| Kim 1989 | Characteristics of Synchrotron Radiation, K. J. Kim, AIP Conference Proceedings 184: Physics of Particle Accelerators (1989) 565 |
| Siegman 1986a | Lasers (University Science Books, Sausalito 1986), A. E. Siegman, pages 558-891 |
| Sakai 2001 | Measurement of an Electron Beam Size with a Laser Wire Beam Profile Monitor, H. Sakai et al, Physical Review Special Topics - Accelerators and Beams 4 (2001) |
| Jones 2001 | Stabilization of Femtosecond Lasers for Optical Frequency Metrology and Direct Optical to Radio Synthesis, R. J. Jones and J. C. Diels, Phys. Rev. Letters 86 (2001) pages 3288-3291 |
| Siegman 1986b | Lasers (University Science Books, Sausalito 1986), A. E. Siegman, 680 |
| Drever 1983 | Laser Phase and Frequency Stabilization Using an Optical Cavity, R. W. P. Drever, J. L. Hall, and F. V. Kowalski, Appl. Physics 31 (1983) 97 |

CONCLUSION

In conclusion it can be seen that embodiments of the present invention may provide an efficient, tunable source of nearly monochromatic energetic electromagnetic radiation at ultraviolet, x-ray and gamma ray wavelengths. Such a source can be constructed using an optical undulator—created by accumulating the phase-coherent, pulsed radiation from one or more pulsed lasers in a matched, near-spherical, low-loss optical cavity—and a relativistic electron beam bunched at the period of the aforementioned optical micropulses and focused and synchronized with the accumulated (circulating) optical micropulses at the interaction (focal) region of the aforementioned optical cavity so that the electron bunches interact with the circulating optical micropulses at the peak intensity of the optical micropulses.

The intensity and efficiency of x-ray production are optimized when the peak power of the pump laser and the reflectivity of the cavity are selected to generate circulating optical micropulses with a normalized optical vector potential greater than 0.1 at the interaction (focal) region of the cavity, and the radiation interval duration of the injected optical pulses and electron bunches is optimized for the given beam size at the mirrors to insure that the fluence and average power of the optical pulses incident on the reflecting surfaces of the optical cavity remain within their damage threshold while maximizing the repetition rate of the pulse trains so created to optimize the average radiated x-ray power.

Embodiments of the invention may also offer the advantage of greatly reducing the average circulating optical power required for efficient x-ray production with tightly bunched electron beams, or of greatly increasing the peak optical power while maintaining the same average power as in a continuous beam, thereby substantially limiting the fluence and average power density of the optical field incident on the highly reflecting mirrors of the optical storage cavity, and therefore substantially reducing the risk of optical damage to these mirrors, figure distortion due to thermal expansion, etc. And the use of such a low duty-cycle pulsed laser beam clearly also substantially reduces the average power to be provided for operation of the system by the pump laser.

Although this prescription is appropriate for generation of the brightest and most intense possible x-ray beams, the actual pulse width and pulse separation of the generated x-rays can be altered at the cost of reduced intensity and brightness by altering the optical wavelength or the optical pulse width and spacing, by changing the Rayleigh parameter for the optical storage cavity, or by changing the electron energy or the angle at which the electrons cross the counter-propagating beam of optical pulses.

While the above is a complete description of specific embodiments of the invention, the above description should not be taken as limiting the scope of the invention as defined by the claims.

What is claimed is:

1. A method of generating energetic electromagnetic radiation, the method comprising, during each of a plurality of separated radiation intervals:

injecting laser radiation of a given wavelength into an optical cavity that is characterized by a round-trip transit time (RTTT) for radiation of that given wavelength, wherein:

at least some radiation intervals are defined by one or more optical macropulses, at least one optical macropulse gives rise to an associated circulating optical micropulse that is coherently reinforced by subsequent optical micropulses in the optical macropulse and the electric field amplitude of the circulating optical micropulse at any given position in the cavity reaches a maximum value during the radiation interval, at least one optical macropulse that gives rise to a circulating optical micropulse consists of a series of optical micropulses characterized in that the spacing between the start of one optical micropulse and the start of the next is sufficiently close to an exact integral multiple (including 1×) of the RTTT for radiation of the given wavelength to provide at least 50% spatial overlap between injected optical micropulses and the circulating optical micropulse given rise to by that optical macropulse, and the injected optical micropulses in that optical macropulse are within ±45° of optical phase with the circulating optical micropulse given rise to by that optical macropulse;

focusing the circulating micropulse at an interaction region in the cavity so that when the electric field amplitude of the circulating optical micropulse is at or near its maximum value, the circulating optical micropulse provides an optical undulator field in the interaction region characterized by a normalized vector potential greater than 0.1;

directing an electron beam that includes a series of electron micropulses toward the interaction region in the cavity;

synchronizing at least some of the electron micropulses with the circulating optical micropulse in the cavity; and focusing the electron beam at the interaction region in the cavity so at least one electron micropulse interacts with the optical undulator field in the interaction region and generates electromagnetic radiation at an optical frequency higher than the laser radiation's optical frequency.

2. The method of claim 1 wherein the injected optical micropulses in that optical macropulse are within ±20° of optical phase with the circulating optical micropulse given rise to by that optical macropulse.

3. The method of claim 1 wherein the spacing between the start of one optical micropulse and the start of the next is substantially sufficiently close to an exact integral multiple (including 1×) of the RTTT for radiation of the given wavelength to provide at least 90% spatial overlap between injected optical micropulses and the circulating optical micropulse given rise to by that optical macropulse.

4. The method of claim 1 wherein the optical undulator field in the normalized vector potential in the range of 0.1-0.5 so that the electromagnetic radiation generated is highly monochromatic.

5. The method of claim 1 wherein the optical undulator field in the interaction region is characterized by a normalized vector potential in the range of 1.0-2.5 so that the electromagnetic radiation generated is relatively broadband.

6. The method of claim 1 wherein, for at least a majority of the radiation intervals, the radiation consists or a single optical macropulse with equally spaced optical micropulses.

7. The method of claim 1 wherein all the optical micropulses in the optical macropulse are spaced by the same integral multiple of the RTTT.

8. The method of claim 1 wherein at least some of the optical micropulses in the optical macropulse are spaced by different integral multiple of the RTTT.

9. The method of claim 1 wherein:

the laser radiation includes an additional series of optical macropulses;

each additional macropulse gives rise to an additional circulating optical micropulse;

each optical macropulse in the additional series includes a series of optical micropulses characterized in that the spacing between the start of one optical micropulse and the start of the next is sufficiently close to an exact integral multiple (including 1×) of the RTTT for radiation of the given wavelength to provide at least 50% spatial overlap between injected optical micropulses and the circulating optical micropulse given rise to by that optical macropulse; and the additional optical macropulse's optical micropulses are interleaved with the optical micropulses of the first-mentioned series of optical macropulses.

10. The method of claim 9 wherein:

the optical micropulses in the first-mentioned optical macropulses are equally spaced;

the optical micropulses in the additional optical macropulses have the same equal spacing as the optical micropulses in the first-mentioned optical macropulses; and the macropulses are interleaved so that each optical micropulse in one of the optical macropulses that is between two succeeding optical micropulses in the other of the optical macropulses is equally spaced between the two succeeding optical micropulses.

11. The method of claim 9 wherein:

the optical micropulses in the first-mentioned optical macropulses are equally spaced;

the optical micropulses in the additional optical macropulses have the same equal spacing as the optical micropulses in the first-mentioned optical macropulses; and the macropulses are interleaved so that each optical micropulse in one of the optical macropulses that is between two succeeding optical micropulses in the other of the optical macropulses is unequally spaced between the two succeeding optical micropulses.

12. The method of claim 9 wherein the first-mentioned optical macropulses and the additional optical macropulses are characterized by different wavelengths.

13. The method of claim 9 wherein:

the laser radiation is generated by first and second separate lasers; and the first-mentioned optical macropulses and the additional optical macropulses are generated by the first and second lasers, respectively.

14. The method of claim 1 wherein the cavity includes one or more mirrors, and further comprising one or more elements for controlling at least one of the following:

the concentricity of at least one cavity mirror, as for example by translation and/or laser backheating of the cavity mirror; and/or the transverse alignment of at least one cavity mirror; and/or the round-trip transit time of the circulating optical micropulses, as for example by mirror translation on the scale and sensitivity of the optical micropulse envelope; and/or the frequency matching of the laser to the optical cavity, as for example by mirror translation on the scale and sensitivity of a fraction of the optical wavelength.

15. The method of claim 1 and further comprising controlling at least one of the following:

the modulation frequency of the laser; and/or the modulation frequency of the electron beam generator; and/or the transverse alignment and timing of the laser radiation; and/or the longitudinal alignment and mode matching of the laser radiation; and/or the transverse alignment and timing of the incident electron micropulses; and/or the synchronization of the optical micropulses from the laser with the incident electron micropulses from the electron beam generator.

16. A method of generating energetic electromagnetic radiation, the method comprising:

generating an optical undulator field in a resonant optical cavity, wherein:

the optical undulator field is provided in an interaction region by an optical micropulse that circulates in the cavity and is focused in the interaction region, and the optical undulator field is characterized by a normalized vector potential greater than 0.1 in the interaction region of the cavity;

directing an electron beam of electron micropulses toward the interaction region in the cavity in a direction having a component along a direction opposite to a direction in which the optical micropulse travels through the interaction region; and focusing the electron beam at the interaction region in the cavity wherein the electron micropulses interact with the optical undulator field and generate electromagnetic radiation at an optical frequency higher than the optical frequency of the circulating optical micropulse providing the undulator field.

17. A method of generating energetic electromagnetic radiation, the method comprising, during each of a plurality of separated radiation intervals:

injecting laser radiation into an optical cavity, wherein:

the laser radiation includes spaced optical micropulses, at least some of the optical micropulses give rise to one or more optical micropulses that circulate in the cavity, the optical micropulses are spaced and phased so that at least some injected optical micropulses coherently reinforce a circulating optical micropulse in the cavity, and the electric field amplitude of each circulating optical micropulse for any given position in the cavity reaches a maximum value during that radiation interval;

focusing each circulating optical micropulse at an interaction region in the cavity so that for at least one circulating optical micropulse, when the electric field amplitude of that circulating optical micropulse is at or near its maximum value, that circulating optical micropulse provides an optical undulator field in the interaction region characterized by a normalized vector potential greater than 0.1;

directing an electron beam toward the interaction region in the cavity wherein the electron beam includes spaced electron micropulses;

synchronizing the electron micropulses with the one or more circulating optical micropulses; and focusing the electron beam at the interaction region in the cavity so as to interact with the optical undulator field in the interaction region and generate electromagnetic radiation at an optical frequency higher than the optical frequency of the circulating optical micropulse providing the undulator field.

18. The method of claim 17 wherein substantially all the optical micropulses are equally spaced during one or more radiation intervals.

19. The method of claim 17 wherein each radiation interval is characterized by a single series of equally spaced optical micropulses.

20. A method of generating energetic electromagnetic radiation, the method comprising, during a finite radiation interval:

injecting laser radiation into an optical cavity in which one or more optical micropulses are circulating, wherein:

at least a portion of the laser radiation has a time dependence characterized by at least one series of spaced optical micropulses characterized by an optical micropulse duration, an optical micropulse phase, and an optical micropulse period, the optical micropulse period is substantially an exact integral multiple (including 1×) of the time interval for an optical micropulse to make a single round-trip transit of the optical cavity, the optical frequency is substantially an exact integral multiple of the micropulse repetition frequency, and during the radiation interval, the electric field amplitude of at least one circulating optical micropulse is coherently reinforced by at least some of the injected optical micropulses and, for any given position in the cavity reaches a maximum value during that radiation interval, focusing each circulating optical micropulse at an interaction region in the cavity so that for at least one circulating optical micropulse, when the electric field amplitude of that circulating optical micropulse is at or near its maximum value, that circulating optical micropulse provides an optical undulator field in the interaction region characterized by a normalized vector potential greater than 0.1;

directing an electron beam toward the interaction region in the cavity, wherein:

at least a portion of the electron beam has a time dependence characterized by spaced electron micropulses characterized by an electron micropulse duration and an electron micropulse repetition frequency, and at least some of the electron micropulses are synchronized with the circulating optical micropulses; and focusing the electron beam at the interaction region in the cavity so at least one electron micropulse interacts with the optical undulator field in the interaction region and generates electromagnetic radiation at an optical frequency higher than the laser radiation's optical frequency.

21. A method of designing and fabricating an optical cavity having spaced curved mirrors and an intervening dielectric plate, the cavity operating to provide a beam focused to a beam waist characterized by a focal radius, the method comprising:

selecting nominal parameters for the plate, the parameters including thickness, angle of incidence, and position in the cavity computing, using the nominal parameters for the plate, a physical mirror separation that provides a particular desired degree of pulse stacking, thereby yielding a first equation that depends on the thickness of the plate;

computing, using the computed mirror separation, contour parameters for the curved mirrors that provide a desired focal radius, thereby yielding a second equation that depends on the thickness of the plate;

manufacturing curved mirrors having contour parameters matching the computed contour parameters;

measuring values of actual contour parameters of the curved mirrors;

using the first and second equations, with the measured values of the contour parameters as fixed values in the first and second equations, to solve for new values for the thickness of the plate and for the mirror separation, the new values departing from the nominal thickness of the plate and the computed mirror separation in a manner that depends on differences between the values of the actual contour parameters and the computed contour parameters; and manufacturing a plate characterized by the new thickness value; and constructing the cavity with the manufactured curved mirrors and the manufactured plate at the new separation.

22. A method of controlling an optical cavity so that at least some optical pulses incident on the cavity coherently reinforce one or more optical pulses circulating in the cavity, the cavity having at least first and second curved mirrors, each of the curved mirrors being characterized by a focal point wherein radiation diverging from the focal point and impinging on that mirror is reflected and focused to the focal point, the method comprising:

controlling at least one of an optical pulse repetition period and a cavity optical length to provide that at least some optical pulses of a given wavelength incident on the cavity have a pulse repetition period that is substantially equal to an integral multiple (including 1×) of the cavity's round-trip transit time for radiation of the given wavelength; and controlling the focal point of at least one of the curved mirrors so that the focal points of the first and second curved mirrors are substantially coincident, said controlling the focal point being independent of said controlling at least one of an optical pulse repetition period and a cavity optical length;

whereupon at least some incident optical pulses coherently reinforce the one or more circulating optical pulses, and the one or more circulating optical pulses are focused at the common focal point.

23. The method of claim 22 wherein said controlling the focal point comprises:

providing a transparent plate in the optical cavity between one of the curved mirrors and that curved mirror's focal point; and controlling a tilt angle of the transparent plate to allow the position of that curved mirror's focal point to be displaced in accordance with the tilt angle.

24. The method of claim 22 wherein said controlling the focal point comprises:

providing a mechanism that deforms one of the curved mirrors to change its curvature; and controlling the mechanism to allow the position of that curved mirror's focal point to be displaced in accordance with the degree of deformation.

25. A method of generating energetic electromagnetic radiation, the method comprising:

injecting radiation of a given wavelength into an optical cavity with the laser radiation occurring during a series of spaced radiation intervals, with each radiation interval including one or more trains of spaced optical micropulses that give rise to one or more respective circulating optical micropulses;

focusing each circulating optical micropulse at an interaction region in the cavity while allowing the circulating optical micropulse to diverge away from the interaction region before encountering a cavity component;

wherein:

the radiation intervals are characterized by a radiation interval duration and a radiation interval repetition frequency, the average power for the radiation intervals over multiple radiation intervals is sufficiently low so as not to cause uncorrectable thermal distortion of the cavity components, the fluence during each radiation interval is sufficiently low so as not to cause local thermal damage to cavity components;

each train of optical micropulses is characterized by an optical micropulse duration and an optical micropulse period, each circulating optical micropulse is coherently reinforced by subsequent optical micropulses in the train of optical micropulses and the electric field amplitude of the circulating optical micropulse at any given position in the cavity reaches a maximum value during the radiation interval, when the electric field amplitude of the circulating optical micropulse is at or near its maximum value, the circulating optical micropulse provides an optical undulator field in the interaction region having a desired amplitude characterized by a normalized vector potential above 0.1, and the divergence angle for the circulating optical micropulse and the distance from the interaction region to the nearest cavity component are sufficiently large that the micropulse intensity and integrated fluence at any given cavity component do not cause an unacceptable level of reversible or irreversible degradation to the cavity component due to thermal or fast-nonlinear phenomena;

directing an electron beam that includes a series of electron micropulses toward the interaction region in the cavity;

synchronizing the electron micropulses with at least one circulating optical micropulse in the cavity; and focusing the electron beam at the interaction region in the cavity so as to interact with the optical undulator field in the interaction region and generate electromagnetic radiation at an optical frequency higher than the laser radiation's optical frequency.

26. Apparatus for generating energetic electromagnetic radiation, the apparatus comprising:

an optical cavity having at least two concave reflectors that are spaced so that radiation injected into said cavity circulates therein and is focused at an interaction region, said cavity being characterized by a round-trip transit time (RTTT) for radiation of a given wavelength;

a laser system directing laser radiation of the given wavelength into said cavity, during each of a plurality of separated radiation intervals wherein, for at least one radiation interval:

said laser radiation includes one or more optical macropulses, at least one optical macropulse includes a series of optical micropulses characterized in that the spacing between the start of one optical micropulse and the start of the next is sufficiently close to an exact integral multiple (including 1×) of the RTTT for radiation of the given wavelength that at least one optical macropulse gives rise to a circulating optical micropulse that is coherently reinforced (at least 50% spatial overlap) by subsequent optical micropulses in the optical macropulse so that the amplitude of the circulating optical micropulse at any given position in the cavity reaches a maximum value during the radiation interval, and each circulating micropulse is focused at said interaction region in said cavity so that when the electric field amplitude of that circulating optical micropulse is at or near its maximum value, that circulating optical micropulse provides an optical undulator field in said interaction region characterized by a normalized vector potential greater than 0.1; and an electron beam generator providing an electron beam directed at said interaction region in said cavity wherein:

said electron beam has a time dependence characterized by spaced electron micropulses, said electron micropulses are synchronized with at least one circulating optical micropulse, and said electron beam generator focuses said electron beam at the interaction region in the cavity so as to interact with the optical undulator field in the interaction region and generate electromagnetic radiation at an optical frequency higher than the laser radiation's optical frequency.

27. The apparatus of claim 26 wherein:

the laser radiation includes an additional series of optical macropulses;

each additional macropulse gives rise to an additional circulating optical micropulse; each optical macropulse in the additional series includes a series of spaced optical micropulses characterized in that the spacing between the start of one additional optical micropulse period and the start of the next is sufficiently close to an exact integral multiple (including 1×) of the RTTT for radiation of the given wavelength to provide at least 50% spatial overlap between injected optical micropulses and the circulating optical micropulse given rise to by that optical macropulse, and the additional optical macropulse's optical micropulses are interleaved with the optical micropulses of said first-mentioned series of optical macropulses.

28. The apparatus of claim 27 wherein:

the optical micropulses in the first-mentioned optical macropulses are equally spaced;

the additional optical micropulses are equally spaced; and the macropulses are interleaved so that each optical micropulse in one of the optical macropulses that is between two successive optical micropulses in the other of the optical macropulses is equally spaced between the two successive optical micropulses.

29. The apparatus of claim 27 wherein:

the optical micropulses in the first-mentioned optical macropulses are equally spaced;

the additional optical micropulses are equally spaced; and the macropulses are interleaved so that each optical micropulse in one of the optical macropulses that is between two successive optical micropulses in the other of the optical macropulses is unequally spaced between the two successive optical micropulses.

30. Apparatus of generating energetic electromagnetic radiation, the apparatus comprising:

a resonant optical cavity having an interaction region;

means for generating, during a series of spaced radiation intervals, an optical undulator field in said interaction region by establishing one or more optical micropulses that circulate in said cavity and are focused in said interaction region, wherein the optical undulator field is characterized by a normalized vector potential greater than 0.1 in the interaction region of the cavity;

means for providing an electron beam of electron micropulses and directing the electron micropulses toward said interaction region in said cavity in a direction having a component along a direction opposite to a direction in which the one or more optical micropulses travel through the interaction region; and means for focusing said electron beam at said interaction region in said cavity wherein the electron micropulses interact with the optical undulator field and generate electromagnetic radiation at an optical frequency higher than the optical frequency of the circulating optical micropulse providing the undulator field.

31. Apparatus for generating energetic electromagnetic radiation, the apparatus comprising:

a laser system providing laser radiation wherein:

said laser radiation includes a series of spaced radiation intervals characterized by a radiation interval duration and a radiation interval repetition frequency, and each radiation interval includes one or more series of spaced optical micropulses;

an optical cavity disposed in the path of said laser radiation so that during each radiation interval micropulses are injected into said cavity and circulate therein, wherein:

said cavity has an optical length that causes each injected optical micropulse to coherently reinforce a circulating optical micropulse in said cavity, so that during each radiation interval, the electric field amplitude of each circulating optical micropulse reaches a maximum power inside the cavity, and said cavity focuses each circulating micropulse at an interaction region in said cavity so that when the electric field amplitude of that optical micropulse is at or near its maximum power, that circulating optical micropulse provides an optical undulator field in said interaction region characterized by a normalized vector potential greater than 0.1;

an electron beam generator providing an electron beam directed at said interaction region in said cavity wherein:

said electron beam has a time dependence characterized by spaced electron micropulses, at least some of said electron micropulses are synchronized with the circulating optical micropulses, and said electron beam generator focuses said electron beam at the interaction region in the cavity so that at least some of said electron micropulses interact with the optical undulator field in the interaction region and generate electromagnetic radiation at an optical frequency higher than the laser radiation's optical frequency.

* * * * *